US009435622B1

(12) United States Patent
Jeng

(10) Patent No.: US 9,435,622 B1
(45) Date of Patent: Sep. 6, 2016

(54) AQUATIC VESSEL FIBER OPTIC NETWORK

(71) Applicant: Ocom Technology LLC, Arcadia, CA (US)

(72) Inventor: Jack Ing Jeng, Arcadia, CA (US)

(73) Assignee: Ocom Technology LLC, Arcadia, CA (US)

( * ) Notice: Subject to any disclaimer, the term of this patent is extended or adjusted under 35 U.S.C. 154(b) by 0 days.

(21) Appl. No.: 15/078,196

(22) Filed: Mar. 23, 2016

Related U.S. Application Data

(63) Continuation of application No. 14/510,086, filed on Oct. 8, 2014, now Pat. No. 9,297,626.

(60) Provisional application No. 61/891,029, filed on Oct. 15, 2013.

(51) Int. Cl.

| | |
|---|---|
| ***B63G 8/28*** | (2006.01) |
| ***F42B 19/01*** | (2006.01) |
| ***F42B 15/04*** | (2006.01) |
| ***F41G 7/32*** | (2006.01) |
| ***F41G 7/22*** | (2006.01) |

(52) U.S. Cl.
CPC ..... *F42B 15/04* (2013.01); *F41G 7/2273* (2013.01); *F41G 7/32* (2013.01); *F42B 19/01* (2013.01); *F41G 2700/005* (2013.01)

(58) Field of Classification Search
USPC ..... 114/316, 20.1, 21.1; 340/851
See application file for complete search history.

(56) References Cited

U.S. PATENT DOCUMENTS

| | | | | |
|---|---|---|---|---|
| 5,748,102 | A | 5/1998 | Barron | |
| 6,600,695 | B1 | 7/2003 | Nugent et al. | |
| 7,798,086 | B2 | 9/2010 | Ruggaber | |
| 8,577,288 | B2 * | 11/2013 | Rhodes | H04B 11/00 114/21.1 |
| 2009/0090286 | A1 | 4/2009 | Korolenko et al. | |
| 2011/0058814 | A1 | 3/2011 | Camilli et al. | |
| 2015/0098705 | A1 | 4/2015 | Motley | |
| 2016/0040968 | A1 | 2/2016 | Jeng | |

OTHER PUBLICATIONS

Notice of Allowance dated Nov. 23, 2015 for U.S. Appl. No. 14/510,086.

* cited by examiner

*Primary Examiner* — J. Woodrow Eldred
(74) *Attorney, Agent, or Firm* — The Mueller Law Office, P.C.

(57) ABSTRACT

Disclosed is a communication network for aquatic vessels. The network comprises an unmanned aquatic vehicle (UAQV) having a warhead. A fiber optic cable is bi-directional and in a closed ring configuration enabling communication within the network and to the UAQV. A power grid cable is in a closed ring configuration and coupled to a generator providing power. A node is coupled to the fiber optic cable and to the power grid cable. A relay station is coupled to the node and in communication with the UAQV. A control center is in communication with the UAQV and facilitates remote control of the UAQV, and programming of a navigational plan for the remote control of the UAQV prior to launch. The fiber optic cable, power grid cable, node and relay station are capable of being located underwater during operation. The UAQV is capable of being launched underwater from open water.

20 Claims, 19 Drawing Sheets

AQUATIC VESSEL FIBER OPTIC NETWORK

CROSS REFERENCE TO RELATED APPLICATIONS

This application is a continuation of U.S. patent application Ser. No. 14/510,086 filed Oct. 8, 2014, which claims priority to U.S. Provisional Application No. 61/891,029, filed on Oct. 15, 2013, both of which are incorporated herein by reference in their entirety.

BACKGROUND

Traditionally torpedoes, such as MK-48s and MK-46s, are designed to destroy adversary aquatic vessels which may be surface vessels or submarine vessels. These torpedoes are typically launched from a launching unit with fiber optic technology between the torpedo and launching unit. The homing devices of these torpedoes may be active/passive SONARs (SOund Navigation And Ranging) or magnetic flux sensors installed in the bow nose area. Typically, torpedoes have one engine/shaft/propeller located in the aft area.

Typically, underwater fiber optic networks connect two fixed points (point-to-point) located on land. Land-based users utilize this technology via Internet and/or telephone communication. With this configuration, there is typically no switching or routing functions underwater. Unmanned Aerial Vehicles (UAV) and Unmanned Ground Vehicles (UGV) are known and usually operate singularly conducting a single mission.

BRIEF DESCRIPTION OF THE DRAWINGS

Other advantages of the present invention will be readily appreciated as the same becomes better understood by reference to the following detailed description when considered in connection with the accompanying drawings wherein.

SUMMARY

Figure 1:
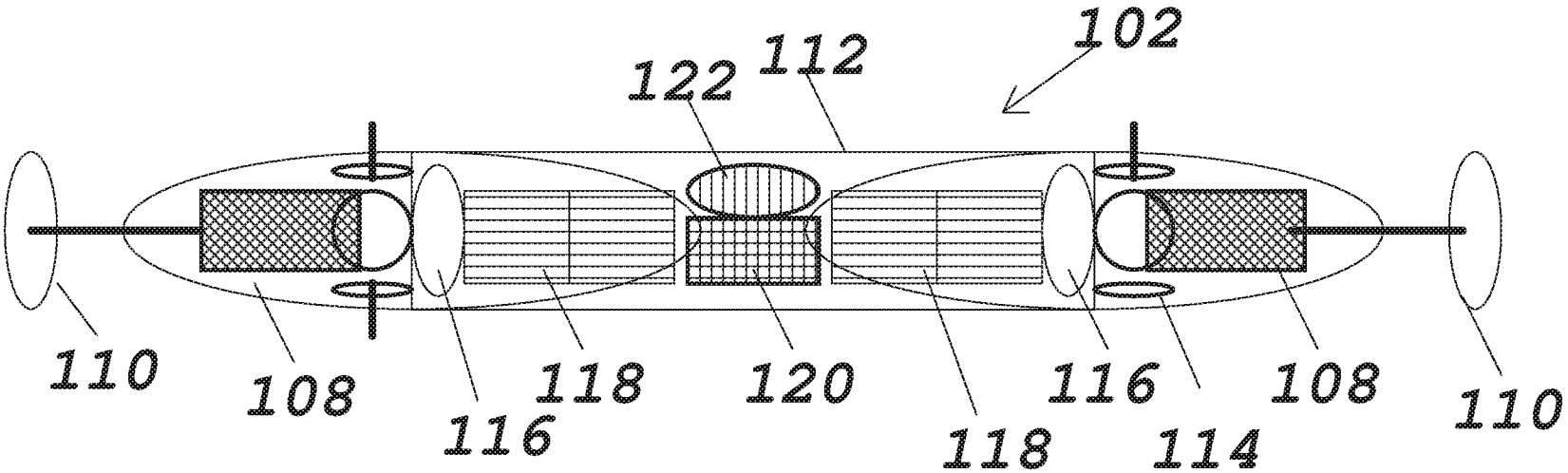
FIG. 1 is a top view of a smart mini torpedo (SMT) component layout.

Disclosed herein is a communication network for aquatic vessels. The network comprises an unmanned aquatic vehicle having a warhead. A fiber optic cable is bi-directional and in a closed ring configuration enabling communication within the network and to the unmanned aquatic vehicle. A power grid cable is in a closed ring configuration and coupled to a generator providing power within the network and to the unmanned aquatic vehicle. A node is coupled to the fiber optic cable and to the power grid cable. A relay station is coupled to the node and in communication with the unmanned aquatic vehicle. A control center is in communication with the unmanned aquatic vehicle and facilitates (i) the remote control of the unmanned aquatic vehicle and (ii) the programming of a navigational plan for the remote control of the unmanned aquatic vehicle prior to launch. The fiber optic cable, the power grid cable, the node and the relay station are capable of being located underwater during operation. The unmanned aquatic vehicle is capable of being launched underwater from open water.

DETAILED DESCRIPTION

Disclosed herein is a communication network for aquatic defense. The network comprises an unmanned aquatic vehicle having a warhead. A fiber optic cable is bi-directional and in a closed ring configuration enabling communication within the network and to the unmanned aquatic vehicle. A power grid cable is in a closed ring configuration and coupled to a generator providing power within the network and to the unmanned aquatic vehicle. A node is coupled to the fiber optic cable and to the power grid cable. A relay station is coupled to the node and in communication with the unmanned aquatic vehicle. A control center is in communication with the unmanned aquatic vehicle and facilitates (i) the remote control of the unmanned aquatic vehicle and (ii) the programming of a navigational plan for the remote control of the unmanned aquatic vehicle prior to launch. The fiber optic cable, the power grid cable, the node and the relay station are capable of being located underwater during operation. The unmanned aquatic vehicle is capable of being launched underwater from open water.

In one embodiment, the unmanned aquatic vehicle may be a smart mini torpedo and may further comprise a periscope. The unmanned aquatic vehicle may be retrievable and reusable when the warhead is nonlethal.

The communication network may include a plurality of unmanned aquatic vehicles and may include a plurality of control centers. The communication within the network may be by mobile communications, satellite communication or fiber optic communication. SONAR technology may be used for surveillance.

The facilitating and programming may be by any of the control centers at any time. A user may provide the remote control of the unmanned aquatic vehicle and the programming of the navigational plan for remote control of the unmanned aquatic vehicle. The navigation plan may include a route, a speed profile, a hull size signature of a target vessel, an engine/propeller sound signature and a type of warhead to be released.

The node may be located between 10 miles to 100 miles from a second node. The node may further comprise a switch or router for performing dynamic switching based on an Ethernet destination address and an Ethernet source address.

In one embodiment, the network may further comprise an aquatic vessel having an antenna and in communication with the relay station. When the aquatic vessel is emerged, the aquatic vessel may be a base station for mobile communications within the communication network. In another embodiment, the network may further comprise an aquatic vessel having a periscope with a satellite antenna and in communication with the relay station or control center. When the aquatic vessel is submerged within periscope length, the aquatic vessel may be a base station for mobile communications within the communication network. In a further embodiment, when the aquatic vessel is submerged deep or beyond periscope length, the aquatic vessel may be a switching hub for smart mini torpedoes.

In another embodiment, the network may further comprise a second fiber optic cable. The second fiber optic cable may enable the communication between the relay station and the unmanned aquatic vehicle. The communication between the relay station and the unmanned aquatic vehicle may be maintained for a radius around the relay station based on the length of the second fiber optic cable. The network may connect to a second network by a third fiber optic cable.

In example embodiments, the fiber optic cable may generate more than 80 Gbps of communication throughput. The power grid cable may provide more than 14.4 kV of electricity. The generator may be located more than 200 miles from the relay station.

Moreover, a method of communication for aquatic vessels is also disclosed. The method comprises providing an unmanned aquatic vehicle having a warhead. A fiber optic cable being bi-directional and in a closed ring configuration is positioned for enabling communication within a network and to the unmanned aquatic vehicle. A power grid cable being in a closed ring configuration and coupled to a generator is positioned for providing power within the network and to the unmanned aquatic vehicle. A node is coupled to the fiber optic cable and to the power grid cable. A relay station is coupled to the node and the relay station is in communication with the unmanned aquatic vehicle. A control center in communication with the unmanned aquatic vehicle is provided and facilitates the remote control of the unmanned aquatic vehicle, and the programming of a navigational plan for the remote control of the unmanned aquatic vehicle prior to launch. The fiber optic cable, the power grid cable, the node and the relay station are capable of being located underwater during operation. The unmanned aquatic vehicle is capable of being launched underwater from open water.

In one embodiment, the communication network is designed to remotely control a plurality of unmanned aquatic vehicles and program a navigational plan for armaments such as a torpedo prior to launch. Mobile communication, satellite communication and/or fiber optic communication may provide the communication means. Because of the flexible, expandable and simple design of the network, a large area, for example, more than tens of thousands square miles,) and/or a long coast line of underwater may be covered by the network. The network is designed for easy maintenance in case of network damage or failure.

The network also provides the electric power required for the unmanned aquatic vehicles and the network itself. The network is also expandable by linking a plurality of networks together allowing coverage of larger ocean geographical areas. The control centers for the network provide distributed coverage for the unmanned aquatic vehicles and permit dynamic insertion or removal of unmanned aquatic vehicles. In this way, the control centers are easily reconfigurable.

A smart mini torpedo (SMT) may be, for example, an unmanned aquatic vehicle (UAqV) which may emerge and submerge as a submarine. FIG. 1 is a top view of a smart mini torpedo component layout. The SMT 102 in this example is a UAQV 100 capable of wireless, satellite and/or fiber optic communications and autonomous sailing. In one embodiment, the SMT 102 may have an engine 108 and a propeller 110 located in the bow of the SMT 102 and the stern of the SMT 102. The engine 108 may be a DC motor having 16.5 HP, 48 V and 5780 RPM (e.g., D&D Motors 170-007-002). Pulse Width Modulation (PWM) may be used to control the engine 108 speed. A step motor 114 and Hall-effect sensors provide rudder and level-control at precise desired angles. A buoyancy tank 116, one located near the bow and another located near the stern, controls the buoyancy and balance of the SMT 102. There are two valves to control water inlet and water outlet.

A battery 118 may be a 24 V lithium ion (e.g., YUASA LIM50-7G 25.9V@47.5 AH, 300 A max) design to support the engine. Field Programmable Gate Array (FGPA) may be used to monitor the battery charging circuit, current, battery status and temperature. An electronic box 120 contains the center control and peripherals sub-system. A pressurized air tank 122 may be capable of 68 ci/4500 psi and may be used to control buoyancy by pushing water out of the buoyancy tank 116.

The SMT 102 is designed to be streamlined having a low profile with minimum size and weight to reduce viscosity drag force. A hull 112 of the SMT 102 is, in an example embodiment, elliptically shaped on both the bow and stern with a cylindrically shaped column between the bow and stern forming a streamlined design. Other shapes may be used. For example, in some embodiments a cone shape or pyramid shape may be used. The bottom of the hull 112 may be formed of a heavy material to accommodate ballast and to aid in balance. The default weight of the SMT 102 is neutral thus having approximately the same density as the sea water. The SMT 102 is designed to be submerged most of time.

In an example embodiment, the dimensions of the SMT 102 may be an elliptically shaped bow and stern have a 22 inch radius with a 6 inch radius cylindrical hull. The volume of the bow and stern may be $(4/3\times22\ \text{in}\times6\ \text{in}\times6\ \text{in}\times\pi)=3317\ \text{in}^3=54{,}364\ \text{cm}^3$ $(1\ \text{in}^3=16.387\ \text{cm}^3)=65.4$ Kg. The center cylindrical hull may be $(6\ \text{in}\times6\ \text{in}\times\pi\times52\ \text{in length})=5881\ \text{in}^3=96{,}373\ \text{cm}^3=97.363$ Kg. The default weight of the SMT 102 may be 65.4 Kg+97.363 Kg=162.763 Kg.

Figure 2A:
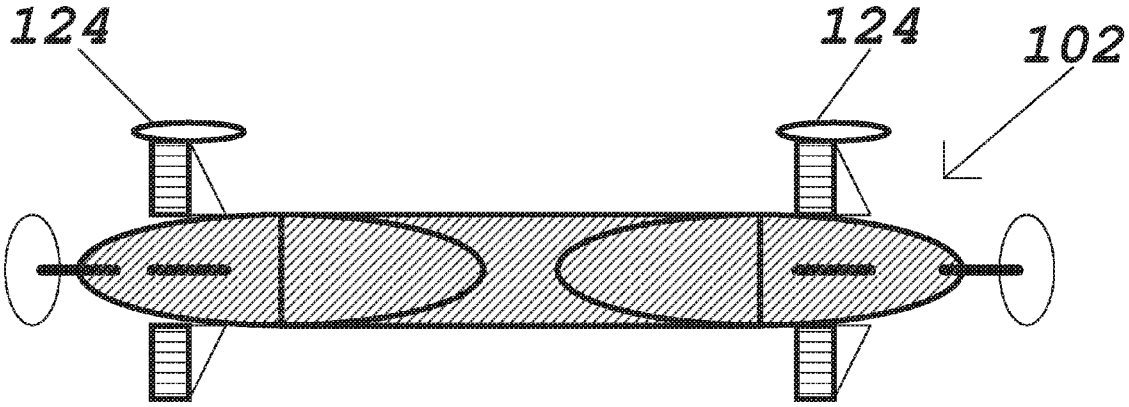
FIGS. 2A and 2B are example embodiments of the side view of the periscope design.
Figure 2B:
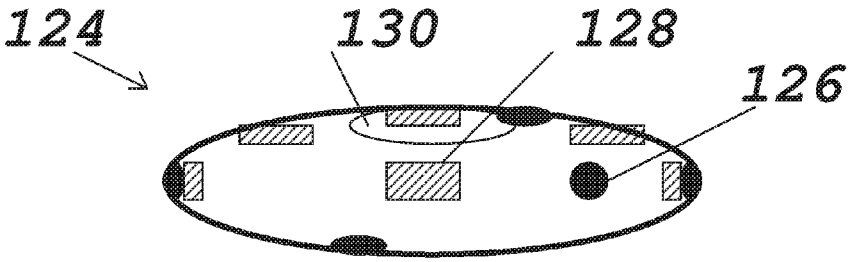

The SMT 102 may also have a periscope for periscope function. FIGS. 2A and 2B are example embodiments of the side view of the periscope design. The periscope 124 is elliptically shaped for a streamlined body which reduces drag force. Other shapes may be used, for example, a teardrop shape or a cone shape. There may be six camera lenses 126 (referred to as 6-Camera) positioned front, left, right, rear, top and bottom to view spherically from the SMT 102. LEDs are used in conjunction with the 6-Camera 126 for illumination. From the camera views, the SMT 102 may use pattern recognition techniques to trace and follow adversary vessels. There may also be six hydrophone/SONAR pads 128 (referred to as 6-SONAR) to detect propeller/engine noise from an adversary vessel. SONAR technology may be used for surveillance. The SMT 102 uses digital signal processing (DSP) from the passive SONAR sensor devices to calculate the distance and direction of the adversary vessel. The 6-SONAR 128 may have a passive mode or an active mode to approach the adversary vessel.

On the periscope 124, antennas 130 are positioned for wireless communication such as Wimax or 4G/5G mobile telecommunications, or satellite communications. In one embodiment, the Wimax 802.16 wireless communication may have up to 35 miles range and 70 Mbps throughput. The 4G/5G mobile telecommunications may have up to a seven mile range while the satellite communication may be thousands of miles away. There is also a global positioning system (GPS) in the periscope 124 for position monitoring.

The periscope 124, in one embodiment, has a digitized SONAR pad. The function of SONAR is to detect sound waves underwater. The sound waves are converted to digital form (Ethernet frame) to reduce transmission loss. The SONAR uses a piezoelectric element to sense the water depth and the sound waves in the water. The SONAR pads are placed at all directions such as on the periscope 124. With digital signal processing, a central control system in the SMT 102 is able to detect an adversary vessel distance, direction and location. A temperature sensor may be attached outside the SONAR for measuring the surrounding water temperature. This scheme may be used to detect adversary nuclear submarines because it generates a large volume of heat. The inside of the SONAR enclosure may be filled with oil not allowing air pockets to form so as to protect the piezoelectric element from the pressure exerted from the water.

A central control system and peripherals logic block may be utilized within the SMT 102. The central control system and peripherals include 6-Camera DSP/Compression, 6-SONAR DSP, navigation block, battery management, DC motor control, step motor control for rudders and level control, wireless/satellite communication, fiber optic communication and buoyancy control. Power over Ethernet or PoE describes any of several standardized or ad-hoc systems which pass electrical power along with data on Ethernet cabling. The PoE 802.3af/at standard interface is used for the central control system to the peripherals for communication and provides the power needed for the peripherals. The battery management and engine module use PoE interface for communication to the central control system and provides the power necessary for the electronics and battery recharge. Additionally, the PoE provides simple interface and high digital data rate (up to 1 Gbps) to the SONAR system.

Figure 3:
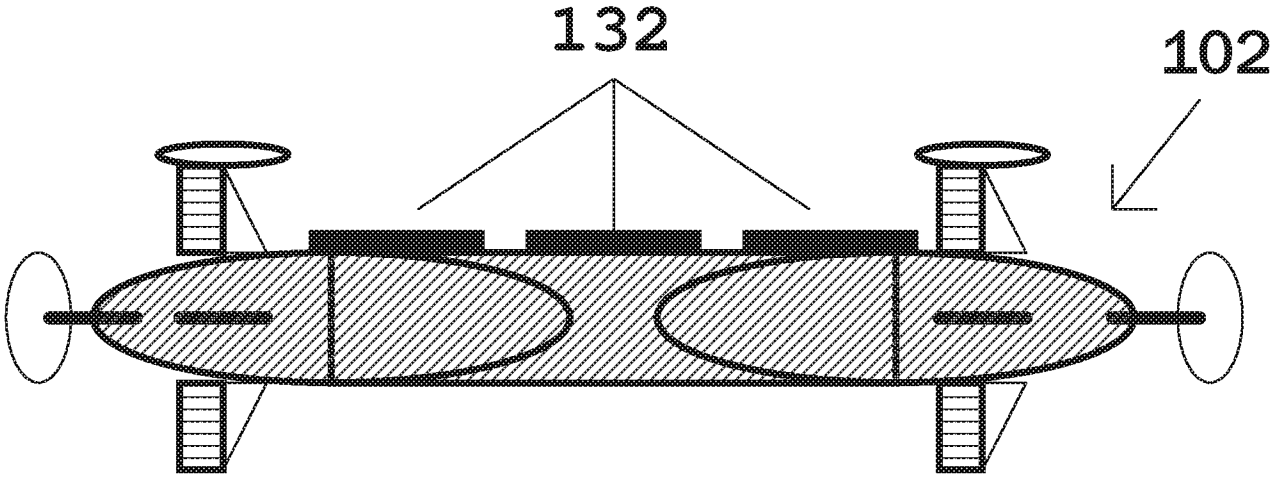
FIG. 3 shows a side view of an example embodiment of the SMT with warheads.

FIG. 3 shows a side view of an example embodiment of the SMT with warheads. In one embodiment, the SMT 102 has a warhead 132 located on top of the hull 112 of the SMT 102. These may be launched by an airbag type of device having an igniter and solid propellant. In different embodiments, a non-lethal warhead 132 is a "net type" device designed to tangle and damage the propeller, shaft/gear and rudder of the adversary vessel. A small dynamite warhead 132 is designed to destroy the propeller/shaft and rudder of the adversary vessel. The large dynamite warhead 132 is designed to destroy the entirety of the adversary vessel. The SMT 102 or UAQV 100 may be retrievable and reusable when the warhead is nonlethal.

A Mother Ship, in one embodiment, is aquatic vessel 444, such as an unmanned catamaran vessel, and may be equipped with one or more SMTs 102. This combination performs warning, tracking, following and disabling an adversary vessel. Non-lethal warheads or lethal warheads may be used to damage or destroy the adversary vessel.

Figure 4A:
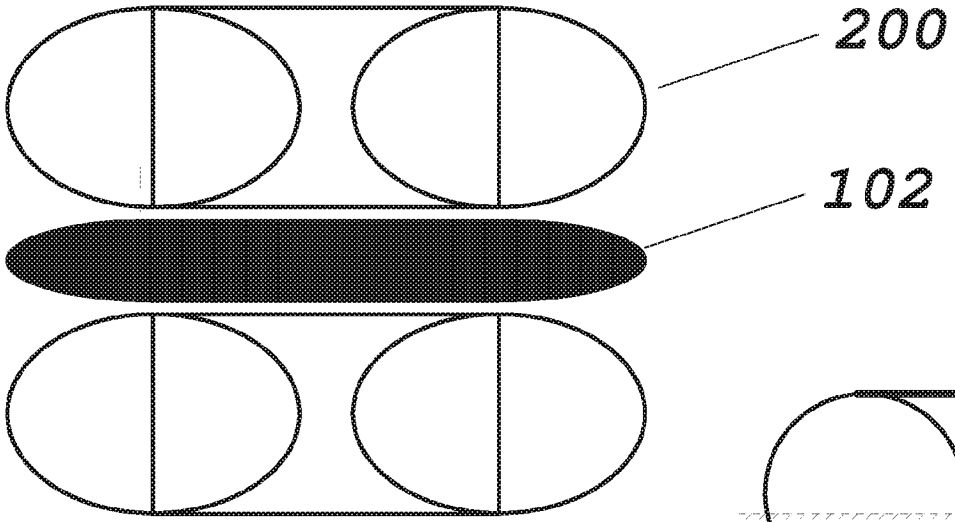
FIGS. 4A, 4B and 4C are example embodiments of the top view, side view and front view of the Mother Ship.
Figure 4B:
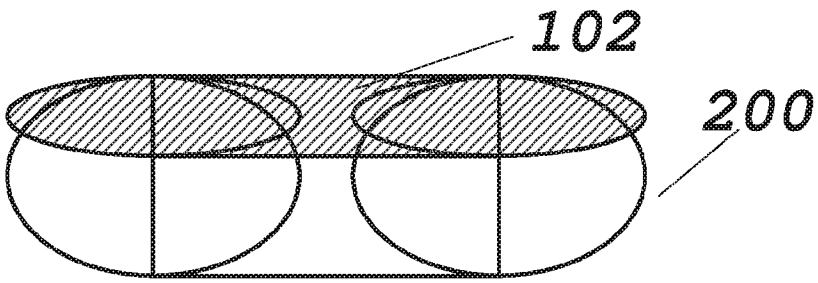
Figure 4C:
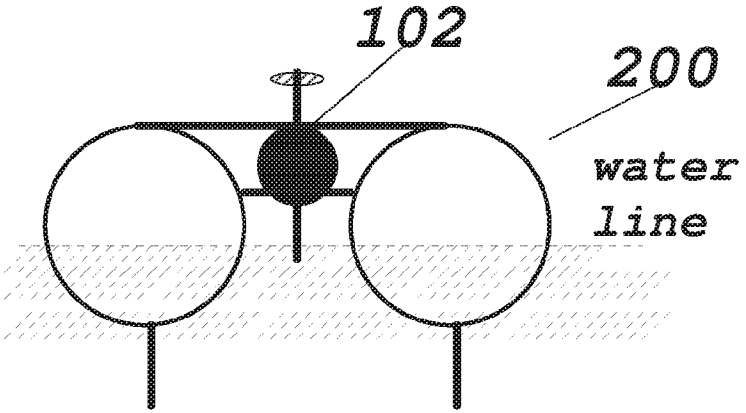
Figure 5:
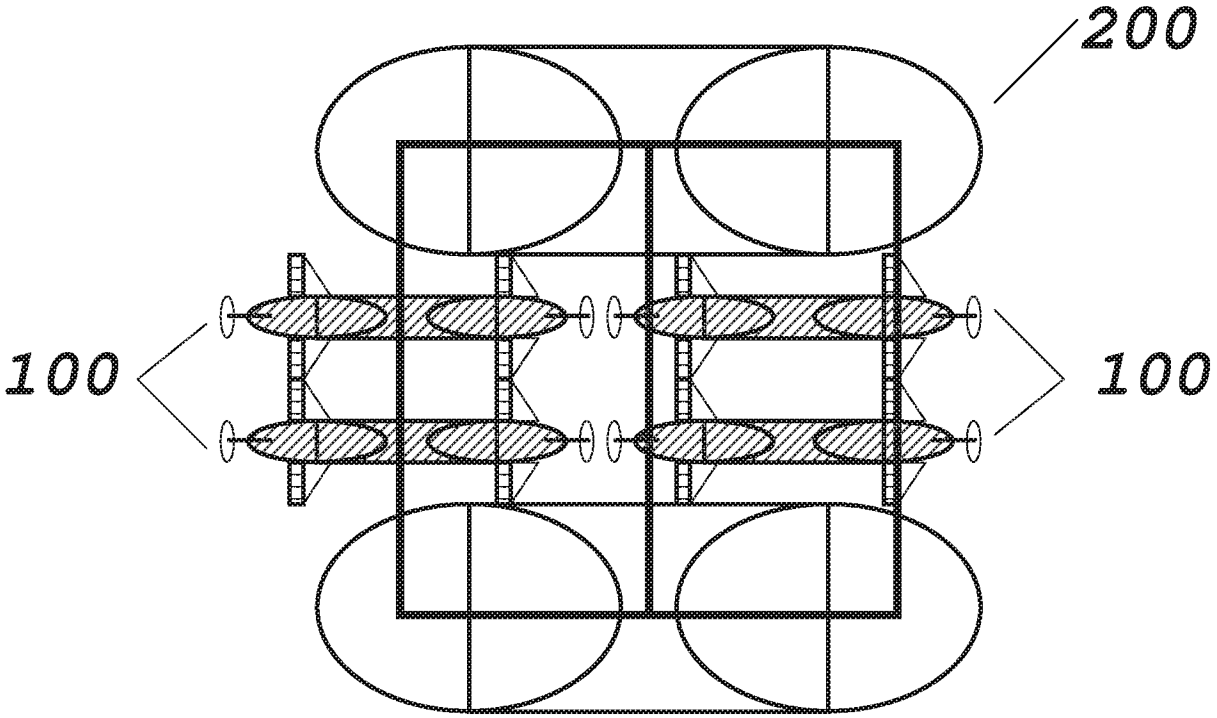
FIG. 5 depicts the top view of one embodiment of a Mother Ship.

FIGS. 4A, 4B and 4C are example embodiments of the top view, side view and front view of the Mother Ship 200. The Mother Ship 200 may supports the weight of the SMTs 102 and stay above the water line level. FIG. 5 depicts the top view of one embodiment of a Mother Ship 200. In one embodiment, multiple SMTs 102 may be mounted on the Mother Ship 200.

Figure 6:
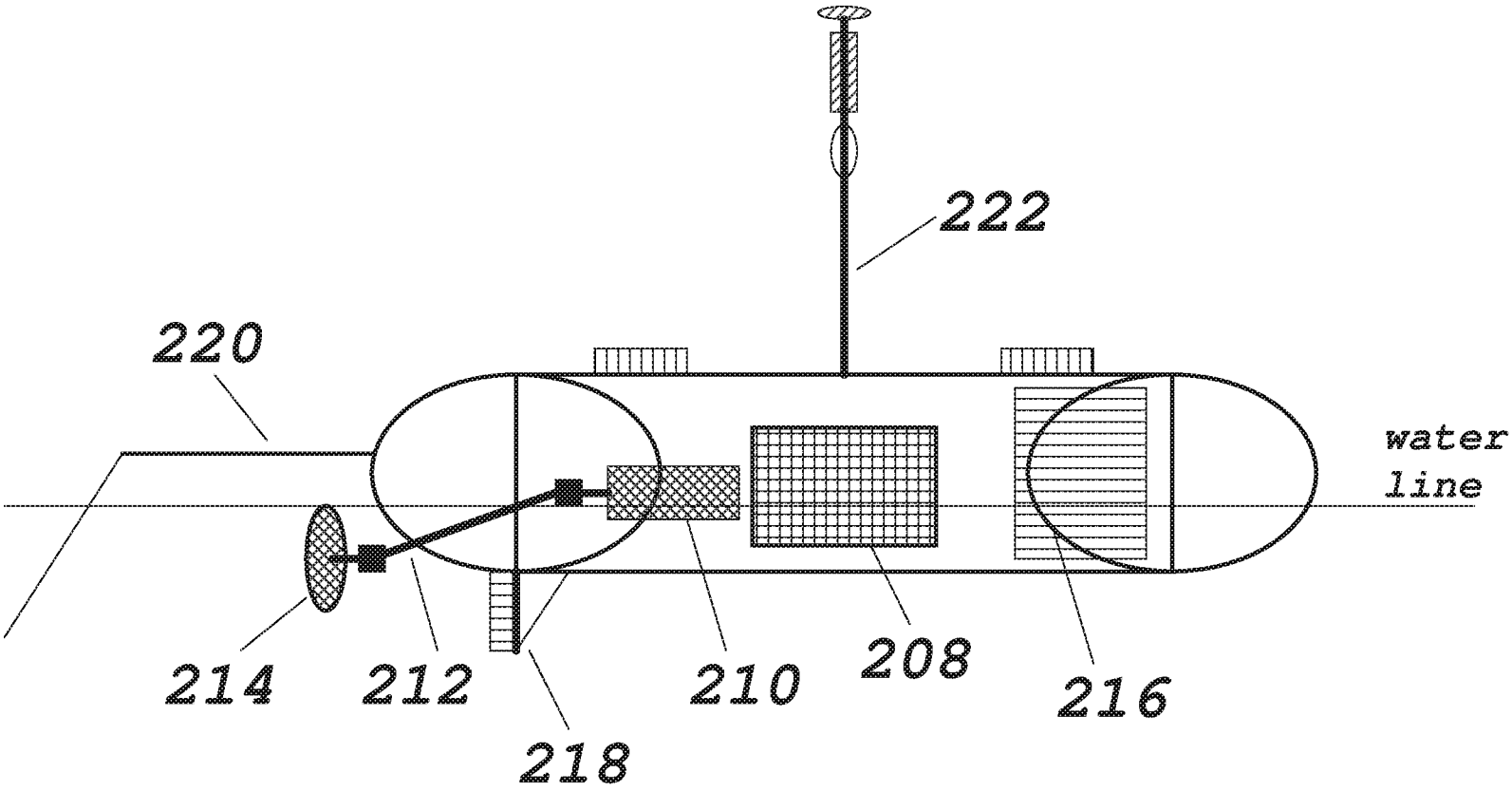
FIG. 6 illustrates an example embodiment of a Mother Ship component layout.

FIG. 6 illustrates an example embodiment of a Mother Ship component layout. In this embodiment, the Mother Ship 200 is a catamaran hull designed to reduce the drag force. To travel at high speeds, the Mother Ship 200 may use dual, high power diesel engines 208 such as a diesel engine with 320 HP. A transmission gear box 210 and shaft with a universal joint 212 drive the Mother Ship propeller 214. A rudder 216 steers the vessel, and a fuel tank 218 stores the fuel. The Mother Ship 200 may be coupled to a UAQV 100, such as the SMT 102, by a cable 220. The cable 220 may provide a fiber optic link to enable communication to the SMT 102 and a power grid cable to supply power to the SMT 102 via Power over Ethernet (PoE). For example, the Mother Ship 200 may recharge the battery in the SMT 102. The Mother Ship 200 is also equipped with a surface-to-air missile, a flare gun, colored smoke solution, loudspeakers and a large LED panel display for warning adversary vessels. The Mother Ship 200 may also be equipped with multiple surveillance cameras to record activity when following an adversary vessel with visual contact from a remote control center via wireless, satellite, or fiber optic communications.

The Mother Ship 200 is designed to support a tall mast 222 for communication. In one embodiment, the mast 222 contains omni-vision cameras, a long range camera, spotlight and loud speakers, satellite communication and mobile communication. The Mother Ship 200 may serve as a WiMAX 4G/5G base station for mobile communication. The mast 222 is at least 14 feet in height and detects a range of at least 5.0 miles ($4.949747 \text{ miles}=((7\times14)/4)^{1/2}$)) in the distance from the horizon. The long range camera may record up to 30 miles of adversary aircraft and vessel surveillance. A camera stabilizer locks the camera on the target. In one embodiment, the base station may be used for wireless communication with the SMT 102. In another embodiment, high speed satellite communication may be used.

A navigation plan for the SMT 102 may be programmed just before launch from the Mother Ship 200 serving as a relay base station from a control center (discussed hereafter) via the cable 220 with the PoE link. The SMT 102 is capable of being launched underwater from open water. The navigation plan includes the planned route, speed profile, hull size signature of the target vessel, engine sound signature and type of warhead to be released. The homing devices include 6-SONAR, 6-Camera and magnetic flux sensors which guide the SMT 102 to the target then ignite the warhead.

The SMT 102 uses a 3-axis gyro accelerometer and a digital compass to adjust to the programmed navigation plan. The default weight of the SMT 102 is neutral or the same weight as sea water at the same volume. This means the SMT 102 uses level control and depth pressure sensors to steer at any desired depth underwater. The buoyancy control may be used when the SMT 102 needs to float on the sea surface to be seen, for example, for retrieval or for wireless/satellite communication.

Figure 7:
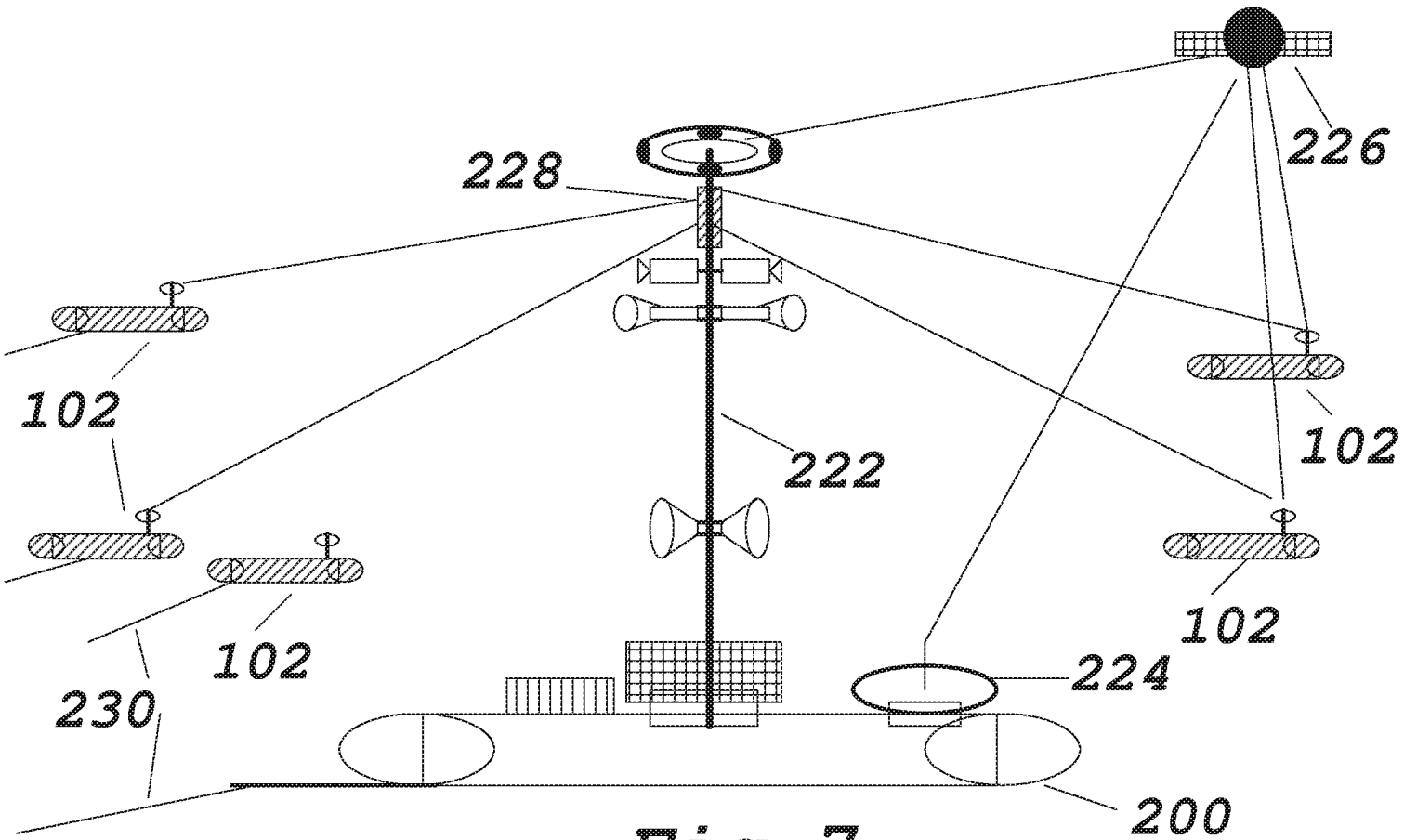
FIG. 7 shows an example embodiment for communication between the Mother Ship and the UAQV.

FIG. 7 shows an example embodiment for communication between the Mother Ship 200 and the UAQV 100, for example, the SMT 102. In one embodiment, an aquatic vessel 444, such as the Mother Ship 200, has an antenna and is in communication with the relay station 316. When the aquatic vessel 444 is emerged, the aquatic vessel 444 may be a base station for mobile communications within the communication network. In another embodiment, an aquatic vessel 444 such as a UAQV 100 has a periscope with an antenna and is in communication with the relay station. When the aquatic vessel 444 is submerged within periscope length, the aquatic vessel 444 may be a base station for mobile communications within the communication network through an antenna on the periscope. In another embodiment, when the aquatic vessel 444 is submerged, the aquatic vessel 444 may use satellite communications within the communication network through an antenna on the periscope.

The Mother Ship 200 may be equipped with a satellite communication dish antenna 224 for communication with a satellite 226 and/or a 4G/5G wireless antenna 229, therefore serving as a base station for mobile communication. In one embodiment, the Mother Ship 200 may use wireless communication such as WiMAX or 4G/5G mobile telecommunication to communicate within the network or with other vessels. In another implementation, the Mother Ship 200 may use satellite communication to communicate remotely. In yet another implementation, the Mother Ship 200 may use a fiber optic cable 228 to communicate remotely.

The Mother Ship 200 may also serve as a relay station for the SMT 102. The Mother Ship 200 may use wireless, satellite and/or a fiber optic cable to communicate with the SMT 102. In one embodiment, the SMT 102 may use WiMAX or 4G/5G mobile telecommunications to communicate with the Mother Ship 200. This may be similar to cellular phone communication with a cellular base station. For example, the SMT 102 may be roaming and establish communication with a first Mother Ship 200 then establish communication with a second Mother Ship 200. As auxiliary communication, the SMT 102 may use satellite communication to contact a control center (discussed hereafter). In a further embodiment, the SMT 102 may use a two-way satellite data transceiver for satellite communication. Additionally, the Mother Ship 200 may use high data rate satellite communication via a large dish antenna. In this way, a SMT 102 may be remotely controlled by a control center hundreds of miles away via the Mother Ship 200 using high data rate satellite communication.

The Mother Ship 200 has various operating modes such as an escort mode, a flare gun firing mode, a short range surface-to-air (SAM) missile payload and a SMT launch mode. During an escort mode, when an adversary vessel enters into maritime territorial sea, for example, within 12 miles, the Mother Ship 200, in one embodiment, may deploy colored smoke to warn the adversary vessel. If the adversary vessel continues to approach, for example, within a few hundred yards, the Mother Ship 200 may broadcast a loud, audible sound with speakers and emit a LED warning sign to signal a more serious warning to the adversary vessel. The Mother Ship 200 may escort the adversary vessel out of the territory. The Mother Ship 200 may use a long range camera or a 6-Camera video recording device while in escort mode.

In the flare gun firing mode, the Mother Ship 200 may fire a flare gun from its payload to warn the approaching adversary vessel or aircraft. In the short range surface-to-air (SAM) missile payload mode, the Mother Ship 200 may be equipped with light-weight, short range surface-to-air missiles such as FIM-92 string infrared homing SAM. These may be launched at adversary vessels or aircraft. The Mother Ship 200 may facilitate launching the SMT 102 with a warhead programmed to either disable the adversary vessel, such as a non-lethal warhead, or destroy the adversary vessel with a lethal warhead.

The SMT 102 has various operating modes such as emerge ready mode, the autonomous submerge mode, the autonomous attack mode, the self-destruction mode and the fiber optic control mode. During the emerge ready mode, the SMT 102 may be controlled and programmed by a nearby Mother Ship 200 using wireless communication, or by a remote control center via satellite communication, or by a Naval Defense Fiber Optic Network (NDFN) control center (discussed hereafter). To conserve battery power, the engine and propeller may be off in this mode.

In the autonomous submerge mode, the SMT 102 is used to track and follow an adversary vessel by using passive SONARs while submerged underwater. SONAR technology may be used for surveillance. This senses the engine sound and/or propeller sound then uses digital signal processing to analyze the position and distance from the adversary vessel. The SMT 102 moves stealthy, slowly and quietly to avoid detection. In an autonomous attack mode, after the SMT 102 is programmed by the Mother Ship 200 or a control center with a navigational plan and proper warhead information, the SMT 102 may close in on the target by 6-SONAR and 6-Camera homing guidance. The warhead is ignited and the explosive is detonated in the warhead.

During a self-destruction mode, if no commands are issued after a timeout period, the SMT 102 may emerge to the surface from underwater and assert a satellite "may day" signal. In one embodiment, if no response is received, the SMT 102 may sink underwater and activate a self-destruction command. In a fiber optic control mode, the SMT 102 may be controlled and programmed by a nearby Mother Ship 200 serving as a control center, while submerged using fiber optic communication or a remote control center via a Naval Defense Fiber-optic Network (discussed hereafter).

A Naval Defense Fiber Optic Network (NDFN) is designed to control large numbers of unmanned aquatic vehicles (UAQV) and their armaments. The NDFN may also provide power for the UAQV enabling it to stay underwater virtually forever as a nuclear submarine. The NDFN has a distributed switching center system thus having less vulnerability and an increase in robustness. The network lies on the ocean floor to avoid detection and is designed for easy expansion to cover a large underwater geographic area. The NDFN deployment is relatively simple as plug and play for UAQVs. The plug and play concept permits networked devices to seamlessly discover each other's presence on the network and establish functional network services for data sharing and communications. A control center for the NDFN provides redundancy, reconfigurability, mobility and stealth capability. This enables a large number of UAQVs in communication with the NDFN to be remotely controlled by distributed control centers and allows the UAQV to be virtually anywhere, at any time, all of the time.

Figure 8:
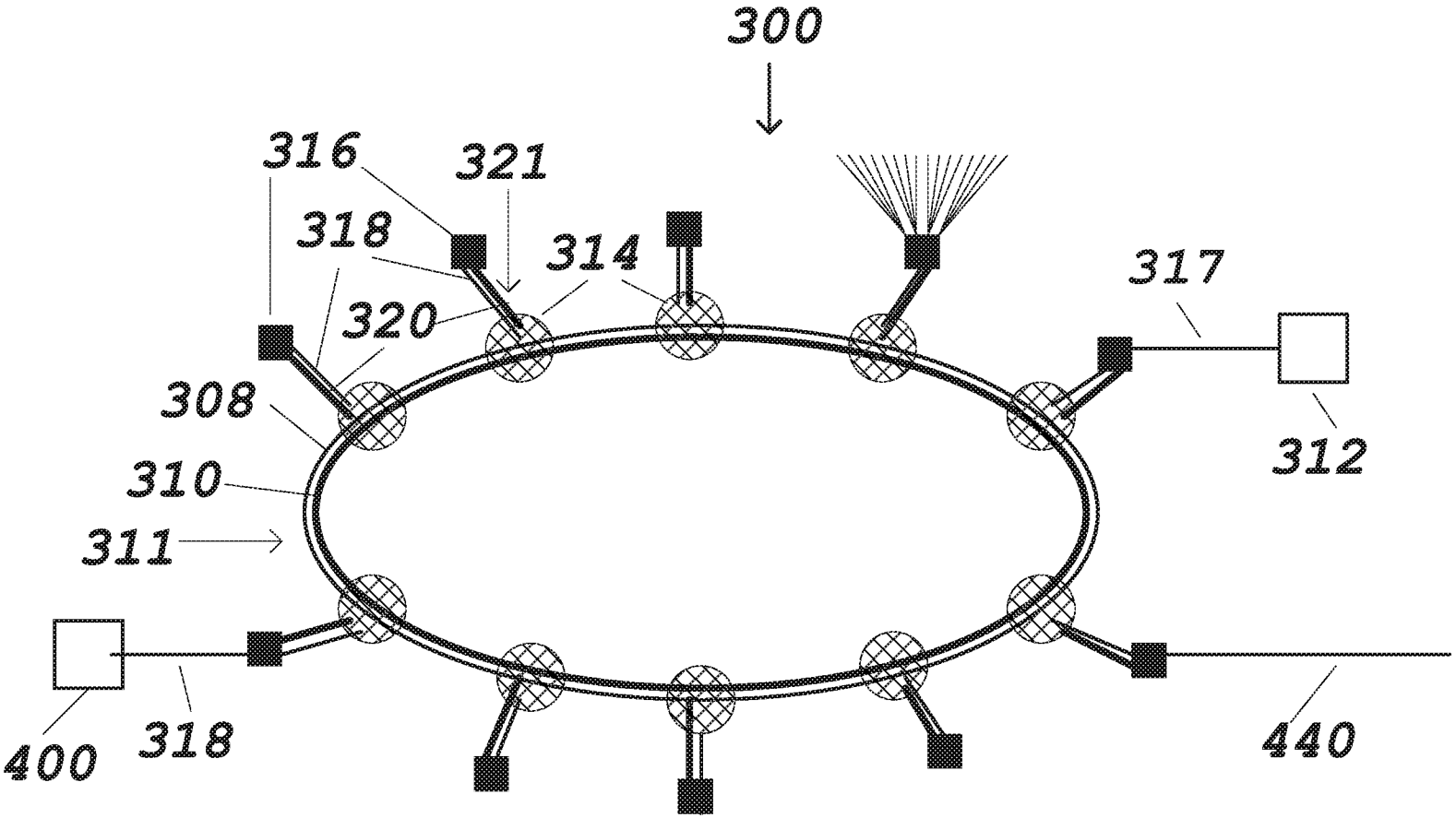
FIG. 8 shows one embodiment of the communication network for aquatic vessels.

FIG. 8 shows one embodiment of the communication network for naval defense or the Naval Defense Fiber-Optic Network (NDFN). The NDFN 300 is a dual, reversible ring topology fiber optic network enabling communication within the network and to a UAQV 100. The NDFN 300 is a closed and secure network making it impervious to spyware. In an example embodiment, the UAQV 100 is a SMT 102. The communication network, NDFN 300, may include a plurality of UAQVs 100. A fiber optic cable 308 is bi-directional and in a closed ring configuration enabling communication within the network and to the UAQV 100. In one embodiment, the fiber optic cable 308 generates more than 80 Gbps of communication throughput. A power grid cable 310 is in a closed ring configuration and coupled to a generator 312 through a network node/relay by HVAC cable 317. This provides power within the network and to the UAQV 100. In one embodiment, the power grid cable 310 provides more than 14.4 kV of electricity. The fiber optic cable 308 and the power grid cable 310 combined may be referred to as the network cable 311.

A node 314 is coupled to the fiber optic cable 308 and to the power grid cable 310. There may be multiple nodes 314 in the network located on the ocean floor in a permanent manner forming the communication infrastructure for aquatic vessels. A relay station 316 is coupled to the node 314 by a second fiber optic cable 318 and a second power grid cable 320 and in communication with the UAQV 100. The second fiber optic cable 318 and the second power grid cable 320 combined may be referred to as the second network cable 321. The fiber optic cable 308, the power grid cable 310, the node 314 and the relay station 316 are capable of being located underwater during operation.

Each node 314 has an associated relay station 316 for the unmanned aquatic vehicle insertion/removal, NDFN expansion, NDFN control center insertion, High Voltage Alternate Current (HVAC) generator insertion and network infrastructure maintenance. The relay station 316 has buoyancy control to emerge or submerge as determined by a control center.

The NDFN 300 may be controlled by a control center 400. In one embodiment, the control center 400 is located hundreds of miles away from the NDFN 300 and may be on land or on a vessel. In one embodiment, the Mother Ship 200 may serve as the control center 400. The control center 400 is in communication with the multiple UAQVs 100, such as the SMT 102, and facilitates the remote control of the UAQV 100, and the programming of a navigational plan for the remote control of the UAQV 100 prior to launch. A user may provide the remote control of the UAQV 100 and the programming of the navigational plan for remote control of the UAQV 100. In one embodiment, after the SMT 102 has been launched, the navigation plan includes the SMT 102 emerging to establish satellite communication before detonation. Once satellite communication are established between the SMT 102 and the NDFN 300, the user may have the option of confirming the navigation plan, modifying the navigation plan or aborting the navigation plan. The SMT 102 then adjusts to the new navigation plan.

Figure 10:
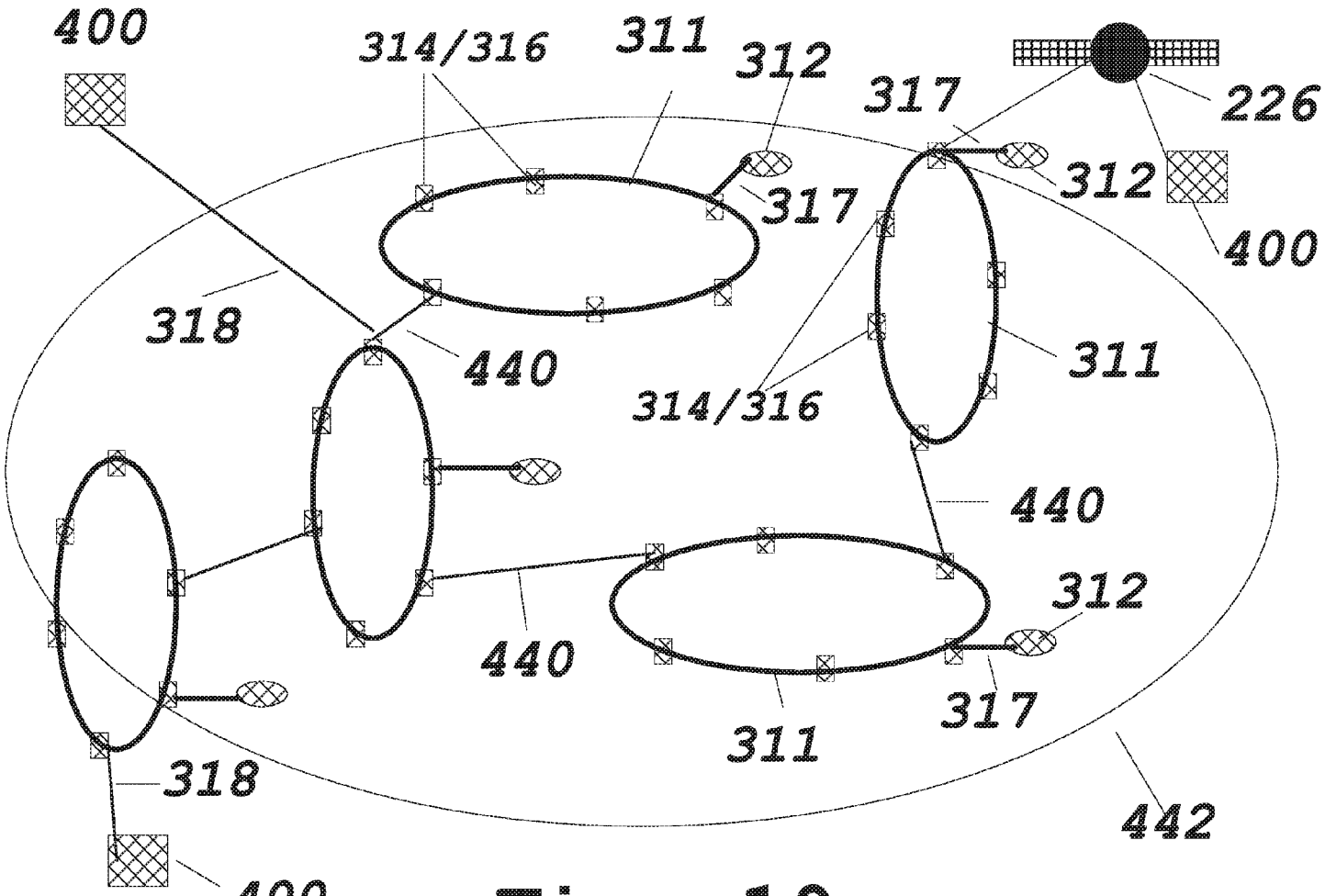
FIG. 10 is an example embodiment of multiple NDFNs.

The communication within the network NDFN 300 may be by mobile communications such as 4G/5G, satellite communications through a satellite 226 or fiber optic communication through a fiber optic cable 318 as shown in FIG. 10. The communication network, NDFN 300, may include a plurality of control centers 400.

Figure 11:
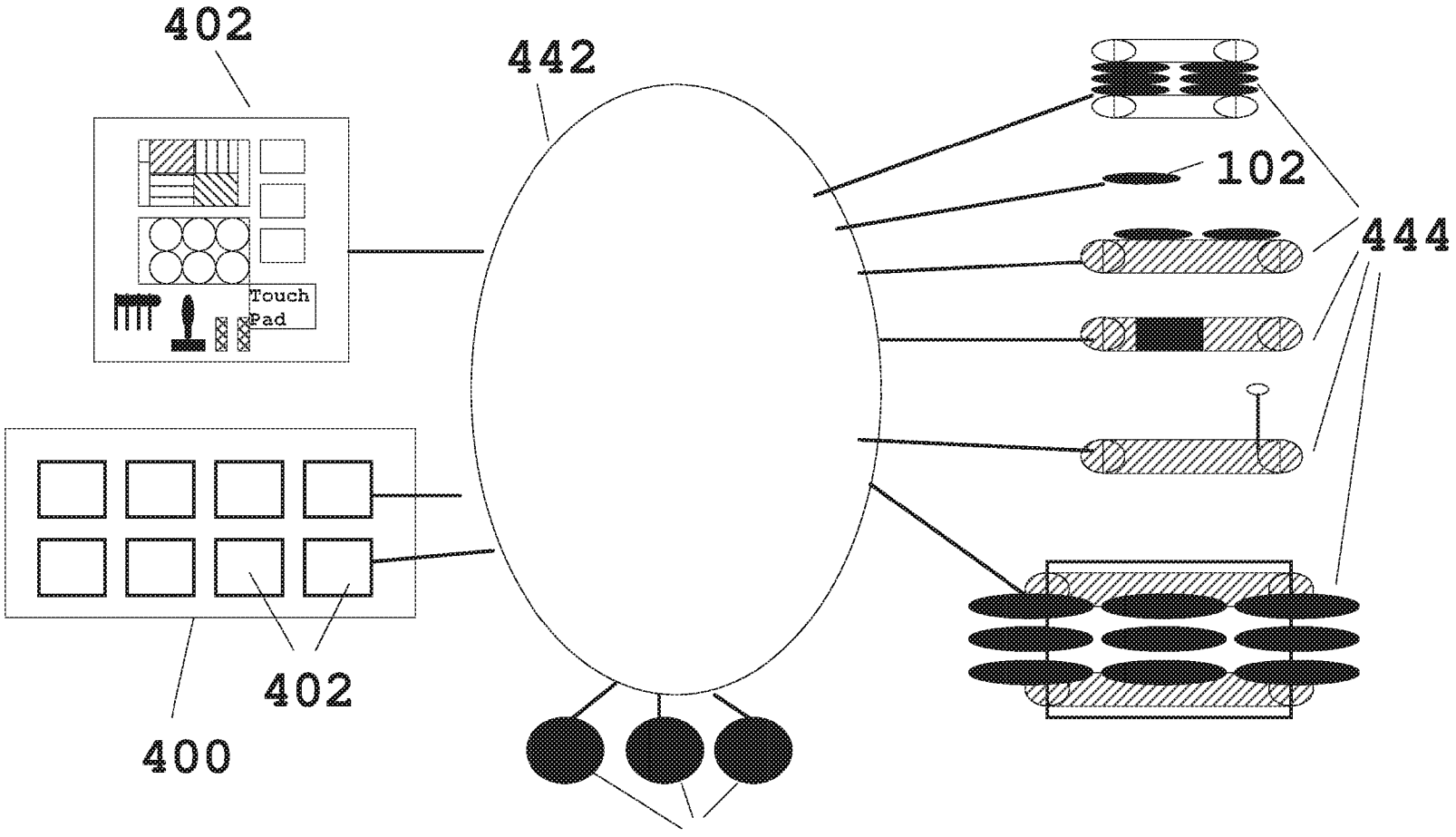
FIG. 11 shows an example embodiment of the NDFN.

Referring to FIG. 11, the control center 400 has a control suite 402. A user, or multiple users, may utilize a pilot seat to monitor and remotely control the UAQV 100. A large screen may be used to monitor activities in a sector of the NDFN 300 or in sectors of the NDFN cloud 442. In one embodiment, a 3-D joystick and foot pedal are used to steer and navigate the UAQV 100. During engagement with an adversary vessel, the user may control the UAQV 100 while another user controls the armament. Multiple touch screen devices may be used to monitor the status of the UAQV 100. Multiple channels of compressed video and SONAR voice may be routed by a network router to the control suite 402 and/or to an administrator for surveillance. The control suite 402 may contain multiple human voice communication channels with non-blocking switching and fast switching such as Push-To-Talk (PTT) for unmanned aquatic vehicle controllers in an aquatic battle situation.

In the control suite 402, the user may monitor the 6-SONAR and the 6-Camera on the SMT 102, Mother Ship 200, node 314 and/or relay station 316. The user may also program and remotely control the payload of the Mother Ship 200 such as long range cameras, 6-Camera, 6-SONAR, flare guns, colored smoke, LED signs and loud speakers.

The facilitating and programming may be by any of the control centers 400 at any time. The control suite 402 in the control center 400 may be assigned to any UAQV 100 of any sector of the NDFN 300 or NDFN cloud 442 by an administrator. In this way, the UAQV 100 and their armaments in communication with the NDFN 300 may be controlled virtually anywhere, at any time, all of the time.

Figure 9:
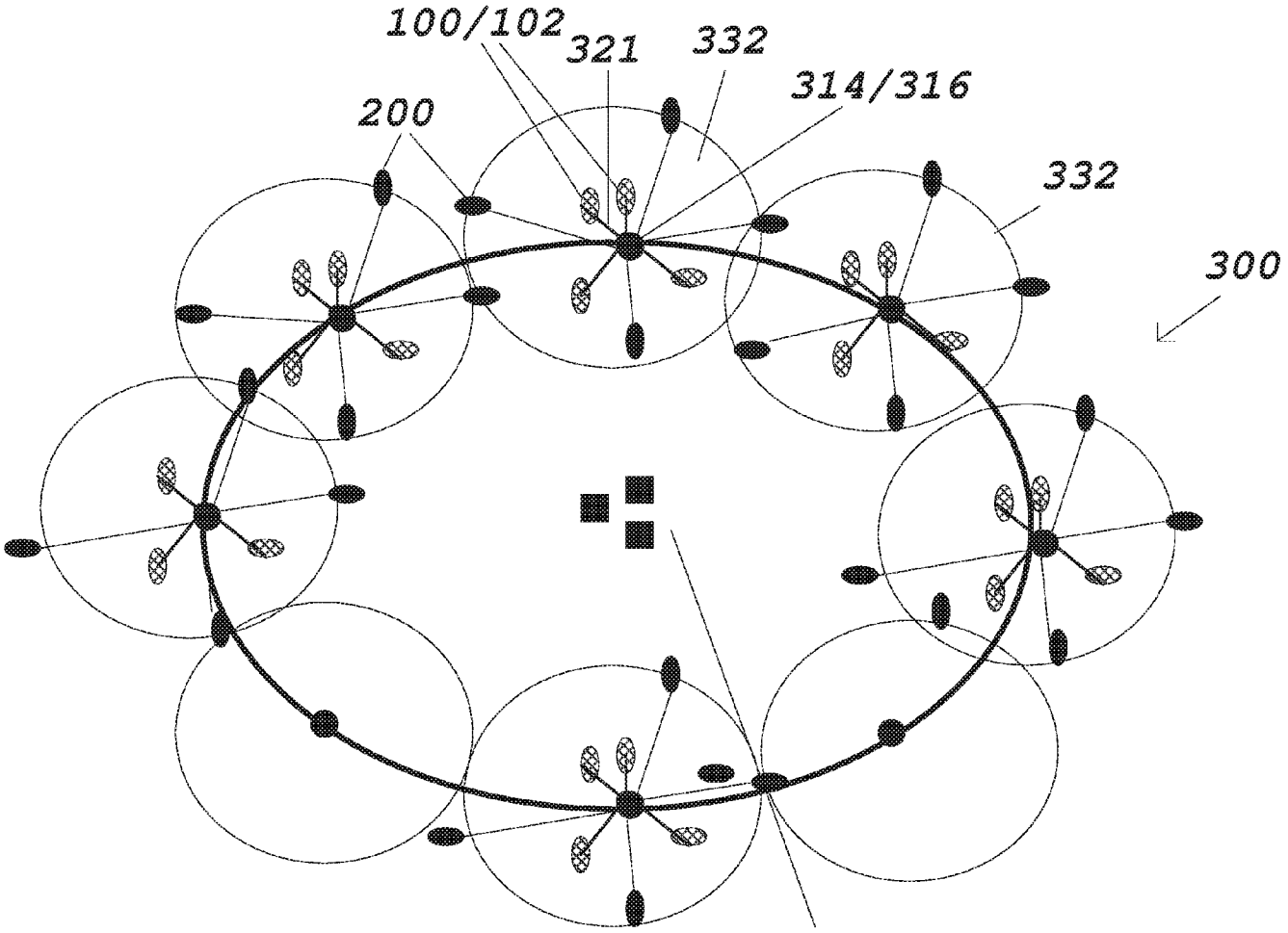
FIG. 9 illustrates an example embodiment of the communication network for aquatic vessels.

FIG. 9 illustrates an example embodiment of the communication network for aquatic vessels. In the example, an NDFN 300 may be located around a territorial island chain 330 or coast line. In one embodiment, the network is more than 24 miles in diameter or the network is up to 12 nautical miles in radius around the island chain 330 or land. Each node 314 is located between 10 miles to 100 miles from a second node 314 on the ocean floor thus covering a wide maritime territory.

The UAQV 100, such as SMT 102, may connect to an outlet on the relay station 316 with the second network cable 321 consisting of the second fiber optic cable 318 and the second power grid cable 320. The SMT 102 does not require a large amount of power to sustain function. When coupled to the second power grid cable 320, the battery 118 of the SMT 102 may be recharged. In this way, the SMT 102 may operate as an unmanned nuclear submarine enabling it to stay underwater virtually forever.

In one implementation, the network may further comprise a second fiber optic cable. The second fiber optic cable may enable the communication between the relay station and the unmanned aquatic vehicle. The communication between the relay station and the unmanned aquatic vehicle may be maintained for a radius around the relay station based on the length of the second fiber optic cable. The SMT 102 is capable of maintaining communication with the network based on the length of the network cable 321. In one embodiment, the network cable 321 is two miles in length, therefore, the SMT 102 is capable of maintaining communication for up to a two mile radius from the relay station 316. In another embodiment, the Mother Ship 200 may be connected to an outlet on the relay station 316 with a fiber optic cable 318. The second power grid cable 320 is not necessary because the Mother Ship 200 generates its own power. In this implementation, the Mother Ship 200 is capable of maintaining communication based on the length of the fiber optic cable 322 or for between 5 and 50 miles in radius from the relay station 316.

Multiple UAQVs 100 and multiple Mother Ships 200 may be coupled to the node/relay stations 314/316 for surveillance and defense. A communication range 332 is detailed in FIG. 9 as an example embodiment. The communication range 332 is based on the length of cable used.

FIG. 10 is an example embodiment of multiple NDFNs 300 linked together. Each NDFN 300, as described herein, consists of the network cable 311, the node/relay stations 314/316 and the generator 312. The generator may be located more than 200 miles from the relay station. The network may connect to a second network by a third fiber optic cable. The NDFN 300 may be linked to another NDFN 300 by a long haul fiber optic cable 440. This forms a NDFN cloud 442 located underwater not in the sky. The NDFN cloud 442 enables users to remotely control a large number of UAQVs 100 anywhere, any time and everywhere, all of the time via the control centers 400 when in communication with the NDFN 300. The control center 400 may be in communication with the NDFN 300 by fiber optic cable 318 or by satellite communications through satellite 226.

FIG. 11 shows an example embodiment of the NDFN. The NDFN 300 couples the UAQV 100 and/or aquatic vessels 444 via the second network cable 321 from the relay station 316. The aquatic vessels 444 may include the Mother Ship 200, a junior J-type underwater vehicle (JJUV), a JJUV-HVAC generator vehicle, a JJUV satellite relay vehicle and a catamaran JJUV underwater missile defense station vehicle. In one embodiment, the aquatic vessels 444, such as a JJUV, uses the second network cable 321 and maintains communication for up to a two mile radius from the relay station 316. Other aquatic vessels 444 not requiring a second power grid cable 320 may maintain communication between 5 and 50 miles in radius from the relay station 316.

Figure 12:
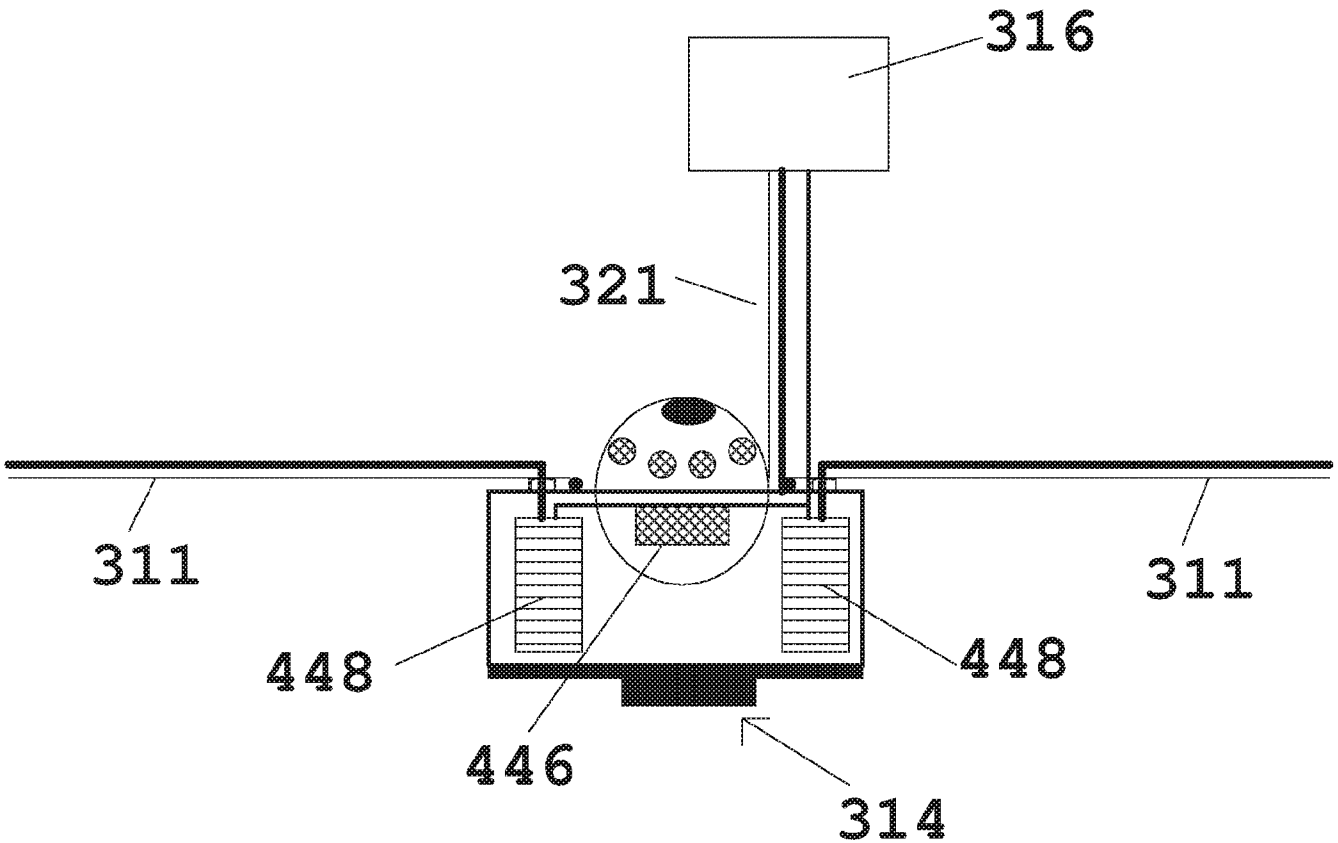
FIG. 12 depicts an example embodiment for the node logic design.

FIG. 12 depicts an example embodiment for the node logic design. The node 314 may be a permanent structure on the ocean floor and be up to two feet by three feet in size. In one embodiment, the node may be located between 10 miles to 100 miles from a second node. The node may further comprise a switch or router for performing dynamic switching based on an Ethernet destination address and an Ethernet source address. The node 314 has an Ethernet switch/router element 446 for the NDFN cloud 442. The node 314 may be equipped with a SONAR array, surveillance cameras and temperature sensors to monitor activities surrounding the node 314 underwater on the ocean floor. The enclosure of the node 314 is designed to tolerate underwater pressure without collapsing.

A power distribution system provides a redundant and robust power source to the load. The node 314 is coupled to the network cable 311 having 14.4 kVAC. In one embodiment, a transformer 448 such as a step down transformer in the node 314 is used to transform 14.4 kVAC to 480 VAC of power which is then distributed to the associated relay station 316 and any attached UAQVs 100. The high voltage may reduce the transmission loss.

In one implementation, the status and management of the power distribution system is constantly recording and monitoring the NDFN 300. In one embodiment, a 14.4 kV HVAC generator may be inserted in the relay station 316. Safety regulations and procedures must be complied with because of the high voltage component. The power grid cable 310 and the second power grid cable 320 may have a circuit breaker device and may be monitored.

In an example embodiment, the NDFN 300 is 102 km in length with 0 gauge wire (0.3224 ohms/km), the total electric resistance is 32.24 ohms. For the generator 312 (with 10 A/14.4 kV), 144 kW is delivered to the NDFN 300. The loss due to the transmission (calculated by $I^2R$) is $10\times10\times32.24=3{,}224$ W with 2.23% loss. For a single UAQV 100, the fiber optic cable 318 is 3 km in length from the relay station 316, with 0 gauge wire, $0.3224\times3=1$ ohms, limited to 5 amp current @ 480 VAC to the UAQV 100. The transmission loss is 25 W, 1% loss. In another example embodiment for ultra-high voltage (230 kVAC) at 300 km with 0 gauge wire, the total electric resistance is 102 ohms. The 230 kVAC @ 0.6 A, 138 kW is delivered to the NDFN 300 where the loss due to the transmission (calculated by $I^2R$) is $0.6\times0.6\times102=36$ W with 0.02% loss.

In one embodiment, multiple generators 312 may be deployed to supply the electric power for the NDFN 300. The generators 312 may be located on a UAQV 100 or land based. The UAQV 100 may use an erectable periscope to gather the air for the generator 312 at a distance such as 30-50 km without detection. Ultra-high voltage, in the order of hundreds of kilovolts, may be used for long journeys, such as hundreds of kilometers for power line transmission. The ultra-high voltage may also supply the electric power to the NDFN 300 through a transformer similar to the transformer 448 located in the node 314.

Figure 13:
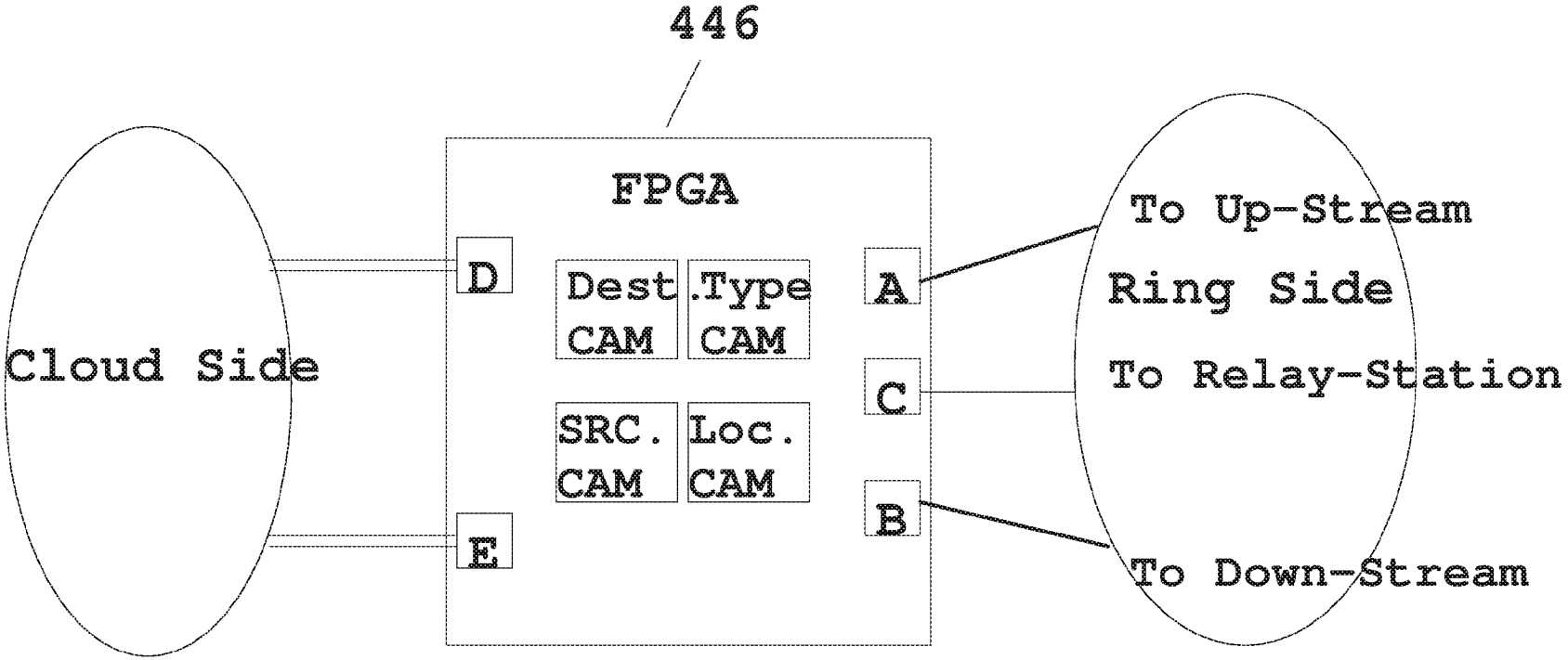
FIG. 13 is an example embodiment of the Ethernet switch/router element.

FIG. 13 is an example embodiment of the Ethernet switch/router element. For multiple ports of the NDFN 300, assuming 10 Gbps Ethernet, IEEE IEEE-802.13ae, the node 314 with the Ethernet switch/router element 446, performs proprietary Ethernet switch/router function. In one embodiment, the Ethernet switch/router element 446 is a 5-Port Ethernet switch/router and is also referred to as a NDFN star-switch. The design of the Ethernet switch/router element 446 includes A-Port: up-stream of the NDFN 300 (80 Gbps); B-Port: downstream of the NDFN 300 (80 Gbps); C-Port: to the relay station 316 (10 Gbps); D-Port: to ring expansion through the long haul fiber optic cable 440 (10 Gbps); and E-Port: to the control center 400 (10 Gbps). Allowable Ethernet frames may be transferred from each of the 5-Ports controlled by the NDFN administrator.

The Ethernet switch/router element 446 mainly is a Field Programmable Gate Array (FPGA) with firmware developed for specific routing algorithm. There is a multiple Content Addressable Memory (CAM). The CAM is a table of Ethernet addresses to be matched against. The matching criteria may be defined by combinations of sub fields of the Source Ethernet Address and the Destination Ethernet Address as specified in FIG. 14. A destination port address associated with each Ethernet address is listed in the CAM table. The function of the CAM is to match an Ethernet address against the CAM table. When there is a match, the destination port is determined and the Ethernet switch/router element 446 transmits the data. The FPGA matches an Ethernet address in a single clock cycle. In one embodiment, the matching process takes 8 nanoseconds for a 125 Mhz system. In contrast, the binary search algorithm for a microprocessor may take hundreds of clocks cycles to match. Multiple CAMs may be used in parallel to match different fields of both source and destination of the proprietary Ethernet address then AND/OR logic is used to find a "match" or "no-match" in a single digit nanosecond period of time. The CAMs are maintained dynamically by the NDFN Administrator.

The basic algorithm of a traditional Ethernet switching is to learn the entire 48-bit Ethernet source address of the plugged in Ethernet node, then the packets destined to the learned port associated with the just plugged in Ethernet node will be routed to the correct Ethernet node. The unlearned Ethernet frames are broadcasted to every port of an Ethernet switch. Once an Ethernet node is connected to the Ethernet switch, the switching route is set and cannot be modified because an IEEE802.3 Ethernet switch uses the CAM that cannot be modified by the user. A compressed video channel typically requires at least 16 Mbps of bandwidth and a voice/SONAR channel typically requires at least 1 Mbps of bandwidth. A UAQV may contain dozens of video and voice channels. In one embodiment, many UAQVs are being controlled and the NDFN delivers only the active UAQV video and voice channels to the proper station. The routing criteria is defined by combinations of sub fields of the Source Ethernet Address and the Destination Ethernet Address as specified in FIG. 14.

In one embodiment, the computer electronics are Ethernet IEEE 802.3 based. The component level modules in the node 314, the relay station 316, the UAQV 100 and the control center 400 are assigned with a unique proprietary Ethernet address. The type of information such as video or voice/SONAR data is also embedded in the assigned proprietary Ethernet address. Industry standard Ethernet switching is used in order to be quickly switched by low Field Programmable Gate Array (FPGA) or Application Specific Integrated Circuit (ASIC). The basic algorithm of the NDFN proprietary Ethernet switching is to control the Ethernet based video and voice channels in such way that only desired video/voice streaming is switched to the designed destination or destinations at certain periods of time. This is known as dynamic switching.

The power grid in the NDFN cloud is managed by an administrator. The Ethernet switch/router element 446 will be at the gate of the NDFN cloud and programmed by the administrator to switch Ethernet frames by the Ethernet destination address and by the Ethernet source address for the associated NDFN 300. In one embodiment, the Ethernet switch/router element 446 is managed by a standard TCP/IP network because of the availability of human/machine interface, graphic user interface (GUI) and network management software.

Figure 14:
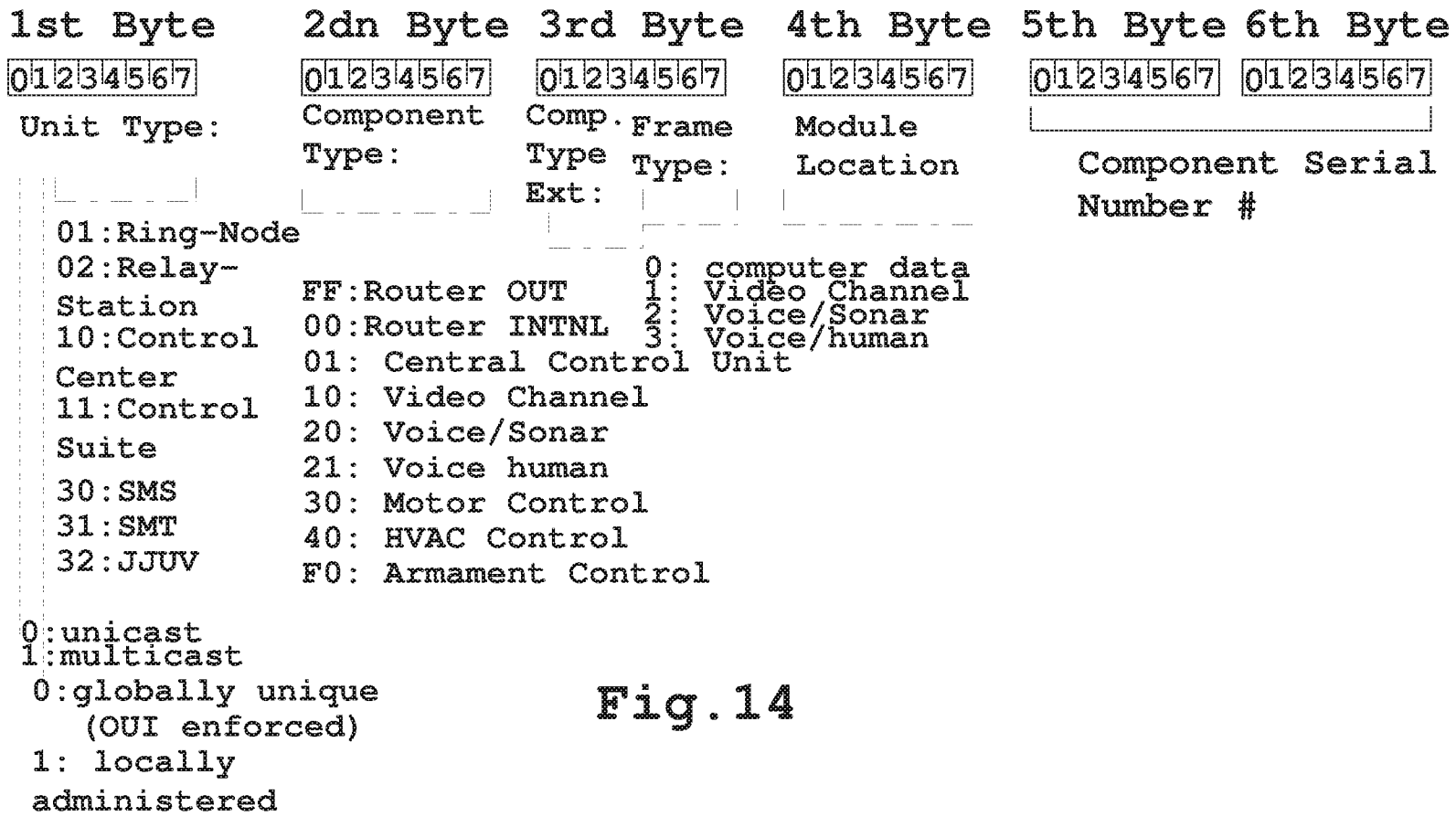
FIG. 14 depicts one embodiment of the NDFN component Ethernet address assignments.

FIG. 14 depicts one embodiment of the NDFN component Ethernet address assignments. The component in the NDFN 300 is defined as a modular level unit that has a unique Ethernet address assigned. A Proper Interface Control Document (ICD) performs a specific function such as the star-switch, the central control module of the UAQV 100, 6-camera 126, 6-SONAR 128, engine control module, power grid control/monitor module, or the like. There are 48-bit, 6 bytes for Ethernet address per IEEE 802.3. The first bit (Bit-0) of the 1st byte which is transmitted first is the unicast/multicast bit. The second bit (Bit-1) "0" for global unique and administered by 802.3 organization and "1" is locally administered. NDFN may use "1" for the Ethernet address assignment. Bit-7 to Bit-2 are assigned to unit type, i.e. "01" for node, "02" for relay station and "10" for control center. The 2nd byte is assigned to NDFN component type: "00" for router internal address, "FF" for Router external address, "01" for component central control system, "10" for Video Channel, and "20" for Voice/SONAR channel. Bit-7 to Bit-4 of 3rd byte are assigned as component type extension. Bit-3 to Bit-0 are assigned to Ethernet frame type: "0" for computer data, "1" for video, "2" for voice and "3" for human voice. The 4th byte is the component installed location for component overflow. The 5th byte and $6^{th}$ byte are the serial number of the component.

Figure 15:
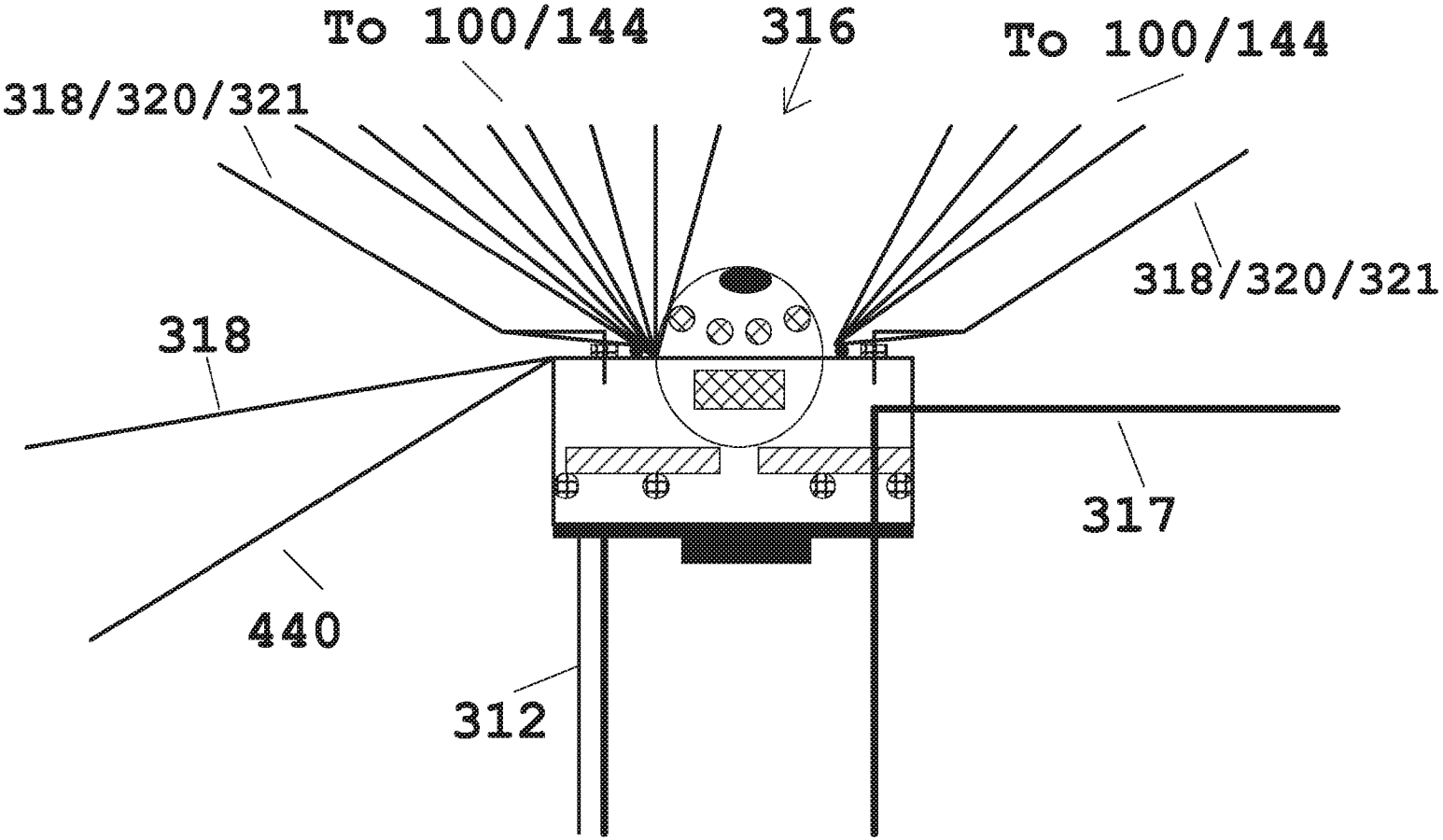
FIG. 15 is an example embodiment of the relay station logic design.

FIG. 15 is an example embodiment of the relay station logic design. Similar to the node 314 physical design, the relay station 316, in one embodiment, is an Ethernet switch in electronic design. The relay station 316 provides 16 of the 1 Gbps fiber optic ports for the attached UAQVs 100 and has a HVAC cable 317 to couple to a generator. HVAC cable 317 may provide 14.4 kV of power. The relay station 316 also provides 480 VAC power outlets for power required for the UAQVs 100. The relay station 316 has a large buoyancy tank and a hydraulic pump instead of a transformer 448 as found in the node 314 configuration. The buoyancy tank enables the relay station 316 to float with the fiber cables and power grid cable attached from the node.

The relay station 316 is also equipped with SONAR array, surveillance cameras and temperature sensors to monitor activities surrounding the relay station 316. SONAR technology may be used for surveillance. The surveillance cameras may monitor and record the status of the attached cables. The enclosure of the relay station 316 is designed to tolerate underwater pressure without collapsing.

Figure 16:
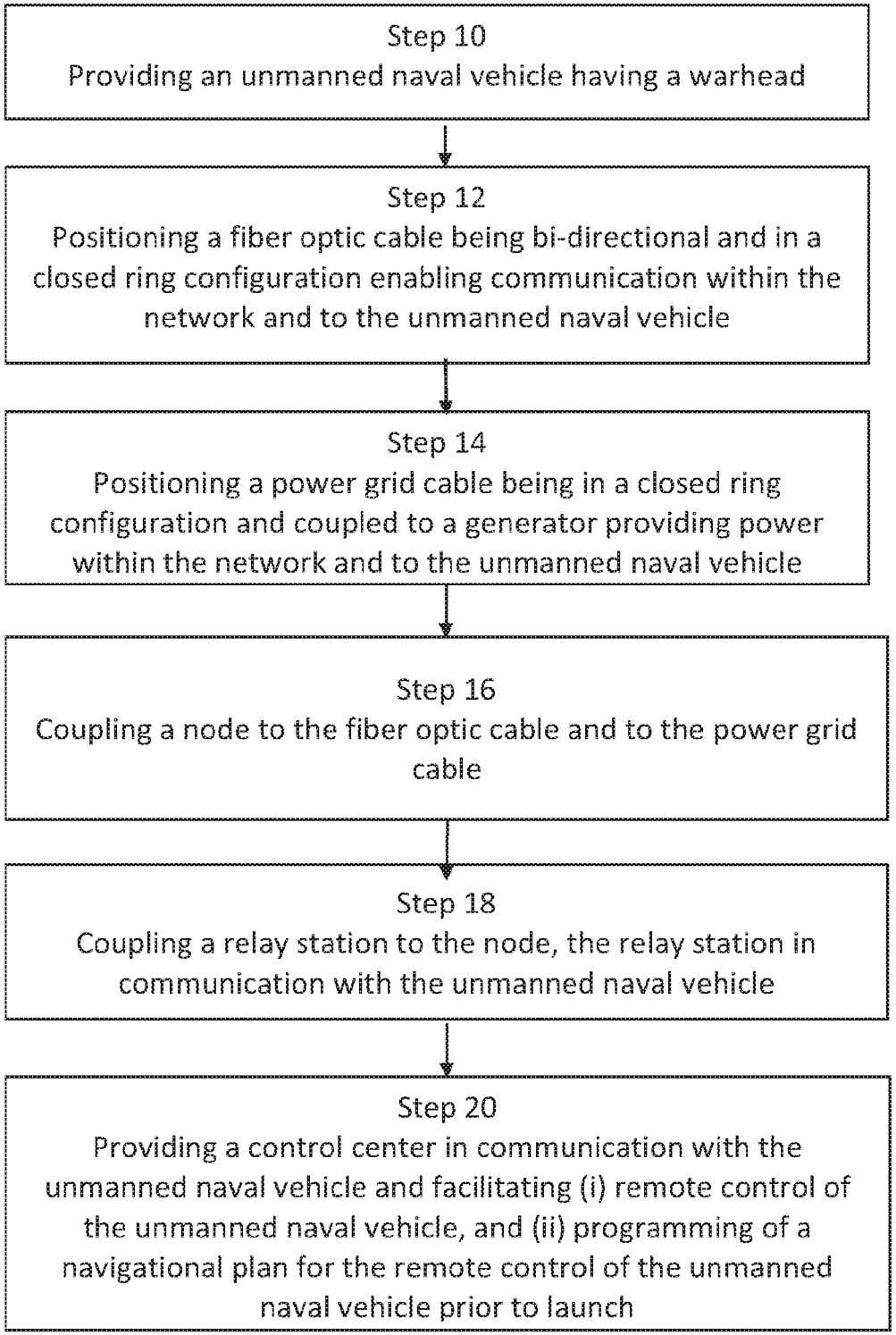
FIG. 16 illustrates a flowchart for the method of communication for aquatic vessels.

FIG. 16 illustrates a flowchart for the method of communication for aquatic vessels. The method comprises at step 10, providing an unmanned aquatic vehicle (UAQV) 100 having a warhead. At step 12, a fiber optic cable 308 being bi-directional and in a closed ring configuration is positioned for enabling communication within a network and to the UAQV 100. At step 14, a power grid cable 310 being in a closed ring configuration and coupled to a generator 312 is positioned for providing power within the network and to the UAQV 100. At step 16, a node 314 is coupled to the fiber optic cable 308 and to the power grid cable 310. At step 18, a relay station 316 is coupled to the node 314 and the relay station 316 is in communication with the UAQV 100. At step 20, a control center 400 in communication with the UAQV 100 is provided and facilitates the remote control of the UAQV 100, and programs a navigational plan for the remote control of the UAQV 100 prior to launch. The fiber optic cable 308, the power grid cable 310, the node 314 and the relay station 316 are capable of being located underwater during operation. The UAQV 100 is capable of being launched underwater from open water.

In a non-limiting example, during operation of the NDFN 300, it may be necessary to stealthy launch a torpedo. The control center 400 located on land hundreds of miles from the SMT 102, is in communication with a plurality of SMTs 102. A SMT 102 is coupled to the relay station 316 via a second network cable 321 and anchored to the ocean floor. In the control suite 402 of the control center 400, a user identifies a suitable SMT 102 and programs the navigational plan for remote control of the SMT 102 prior to launch.

The navigation plan includes a route, a speed profile, a hull size signature of a target vessel, an engine sound signature and a type of warhead to be released. The SMT 102, located underwater in the open water without a host vessel, receives the navigation plan through the NDFN 300 and reacts by releasing the anchor and the second network cable 321 then seeks the target by executing the navigation plan. A torpedo tube, propulsion system, expulsion system and guide-wire are not necessary or needed because the SMT 102 is programmed and powered by the engine 108 by its own accord. The SMT 102 uses homing devices such as 6-SONAR, 6-Camera and magnetic flux sensors to guide it to the target. The warhead is ignited when appropriate.

Figure 17:
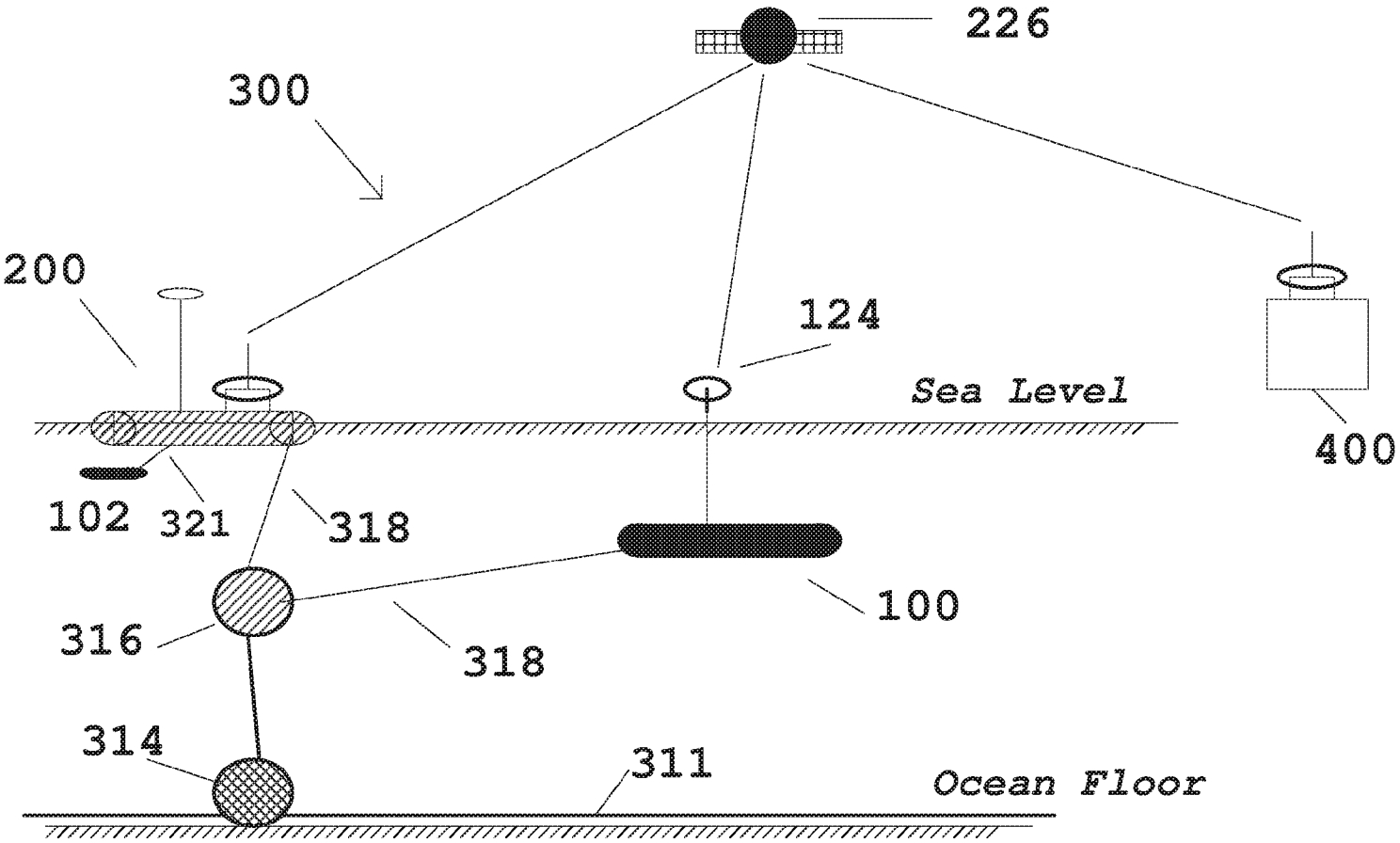
FIG. 17 illustrates an example embodiment for the NDFN.

In another non-limiting example, FIG. 17 illustrates an example embodiment for the NDFN. In this implementation, the control center 400 is located on land hundreds of miles from the Mother Ship 200 and communicates with the NDFN 300 via satellite communication through a satellite 226. The Mother Ship 200 is on the sea level surface and serves as the relay station 316 for the satellite communication between the NDFN 300 and the control center 400 via the fiber optic cable 318 from the associated relay station 316. The Mother Ship 200 is equipped with the SMT 102 through a second network cable 321. The SMT 102 is located underwater in the open water without a host vessel. The UAQV 100, such as the JJUV, may also serve as a stealth relay station 316 located underwater but within the periscope 124 length of, in one embodiment, 65 feet for satellite communication between the NDFN 300 and the control center 400.

In the control suite 402 of the control center 400, a user remotely controls the SMT 102 by multiple screens, a 3-D joystick and foot pedals to steer and navigate. During the operation of the NDFN 300, it may be necessary to stealthy launch a torpedo. A user identifies a suitable SMT 102 from the available SMT 102 within the NDFN 300. Next, the user programs the navigational plan for the remote control of the SMT 102 prior to launch.

The SMT 102 receives the navigation plan through the NDFN 300 via the Mother Ship 200 and reacts by releasing the second network cable 321 then seeks the target by executing the navigation plan. A torpedo tube, propulsion system, expulsion system and wire are not necessary or needed because the SMT 102 is programmed and powered by the engine 108 by its own accord. The SMT 102 uses homing devices such as 6-SONAR, 6-Camera and magnetic flux sensors to guide it to the target.

The navigation plan includes the SMT 102 emerging from underwater and establishing satellite communication. When the SMT 102 emerges satellite communication is established and the user has the option to confirm, modify or abort the navigation plan. The user chooses to abort the navigation plan so that the SMT 102 is now retrievable and reusable.

In another embodiment, the SMT 102 may be located on the Mother Ship 200 such as in FIGS. 4A, 4B and 4C instead of underwater, in open water. In this implementation, when the SMT 102 is ready to be launched, the SMT 102 is released into the water prior to launch.

Figure 18:
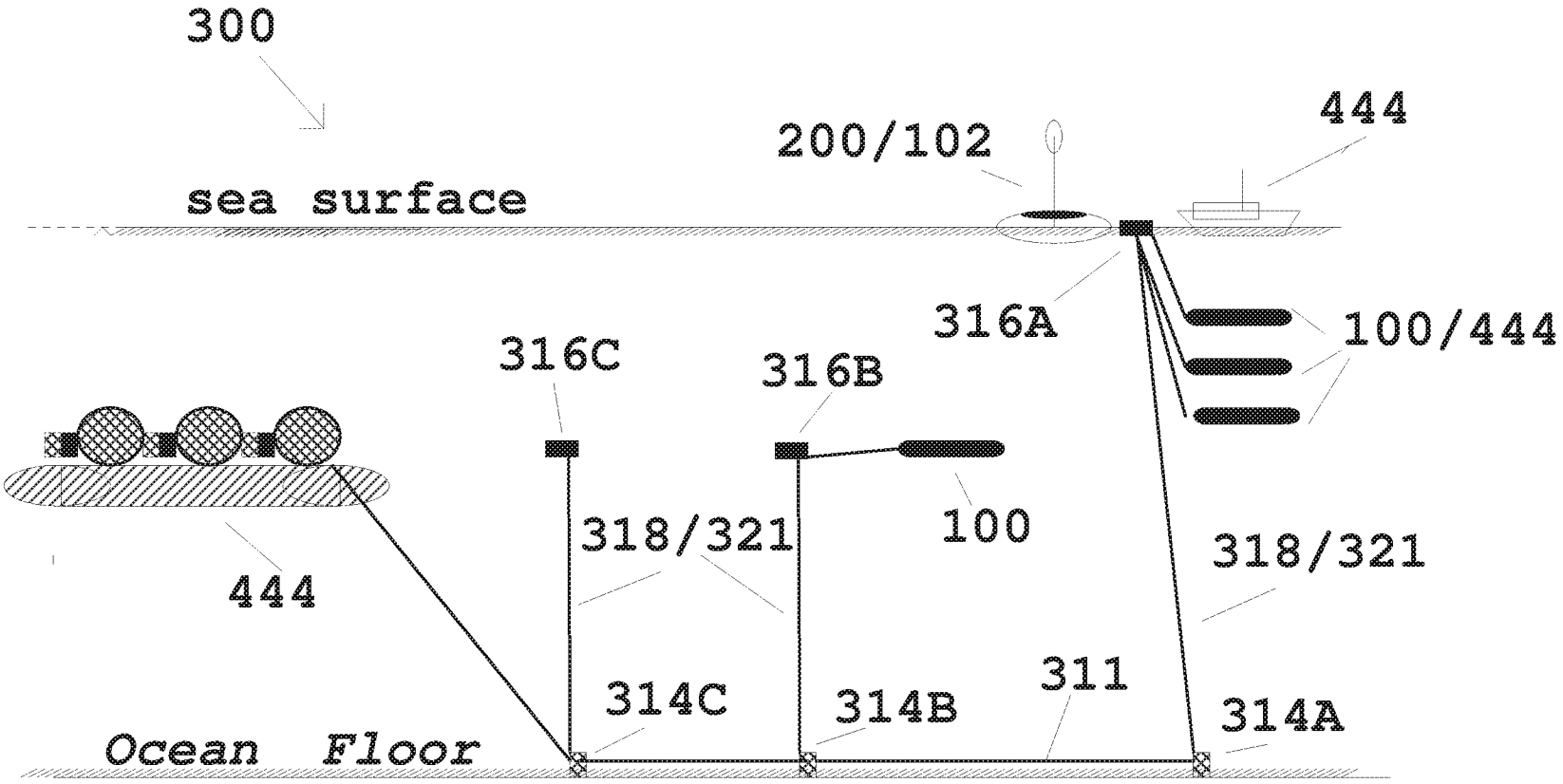
FIG. 18 depicts an example embodiment for the NDFN.

FIG. 18 depicts an example embodiment for the NDFN. In this implementation, stealth deployment techniques are demonstrated. In this way, it may be harder to detect the presence of the NDFN 300 by radar, visual, sonar, and/or infrared methods. The NDFN 300 may be deployed underwater stealthy and silently to avoid detection by an adversary. In one embodiment, the NDFN 300 may be deployed using an aquatic vessel 444 such as a catamaran-JJUV, equipped with the necessary components and spools of cables such as fiber optic cables and power grid cables to construct the NDFN 300. Then, UAQVs 100 such as SMT 102 and aquatic vessels 444, such as the Mother Ship 200 may be added to associated relay stations 316A, 316B and 316C by the second fiber optic cables 318 or second network cables 321. For example, after the NDFN 300 is constructed, the relay station 316A is emerged by the initial battery power. The UAQVs 100 or aquatic vessels 444 may be connected to the relay station 316A. In one embodiment, up to 16 vessels may be connected to a single relay station 316A or 316B or 316C. The fiber optic cable 318 to the control center 400, generators 312 and long haul fiber optic cable 440 may also be connected to the relay station 316B or 316C.

Figure 19:
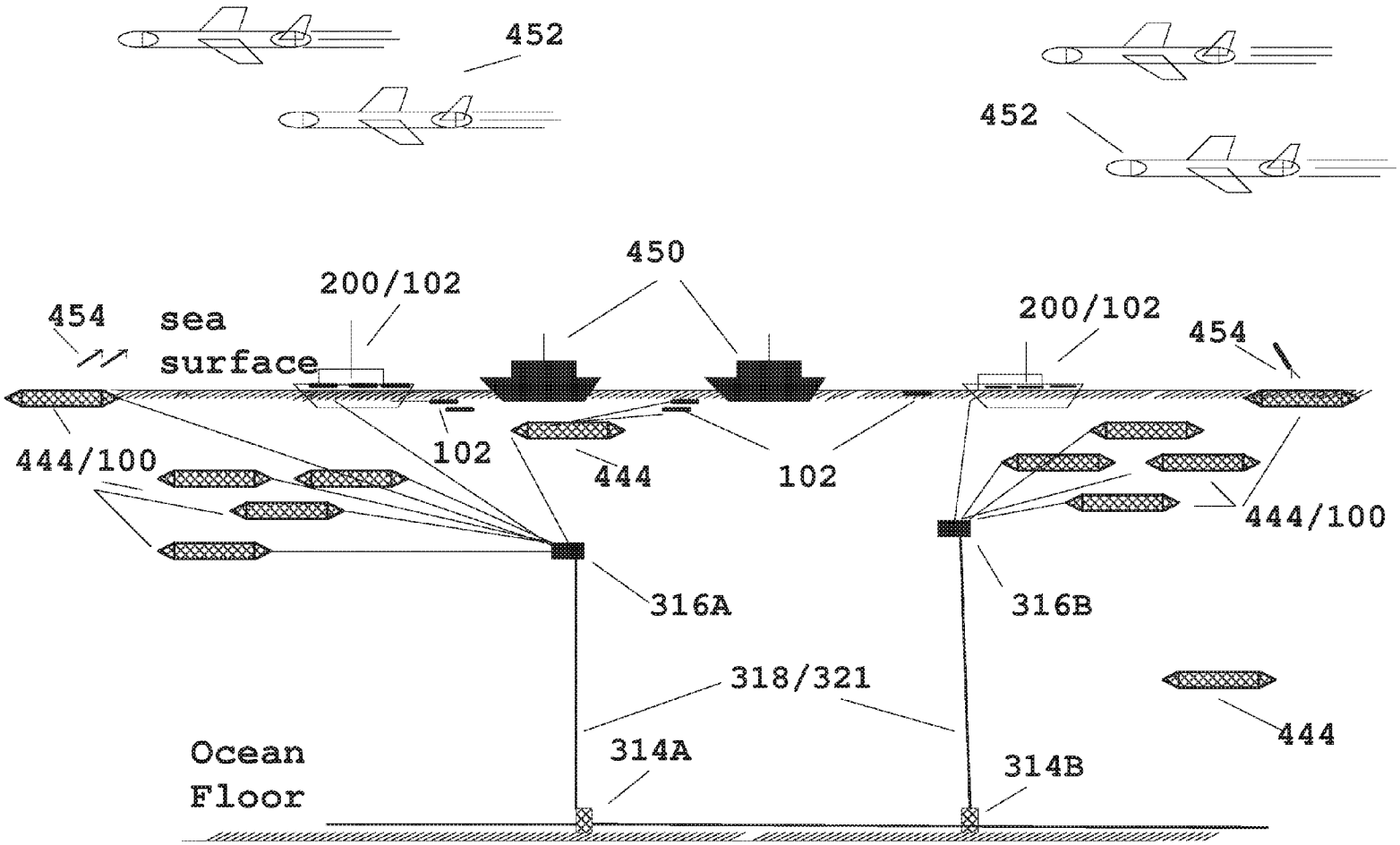
FIG. 19 shows an example embodiment for the NDFN.

FIG. 19 shows an example embodiment for the NDFN. This implementation is a 4-dimensional naval defense strategy using the NDFN 300. The control of the NDFN cloud 442 may be distributed among multiple control centers 400 via satellite communication or fiber optic cables to a mobile control center 400 located on an aquatic vessel 444. The UAQVs 100 and their armament may be controlled anywhere, any time and everywhere and all of the times through the control centers 400 against adversary ships 450 or adversary aircraft 452. The NDFN 300 defends the sea surface as well as the underwater territory. Moreover, the NDFN 300 may also defend the aerial territory by surface-to-air missiles 454 launched an aquatic vessel 444, such as the Mother Ship 200 or a JJUV. The surface-to-air missiles 454 may be a short, mid or long range variety.

A mid-range or long range missile may be mounted on the aquatic vessel 444 such as a catamaran JJUV. The catamaran JJUV may stay submerged during peaceful times and be coupled to and remotely controlled by the NDFN 300 through a control center 400. An underwater missile station (UMS) is constantly moving to avoid detection and may also be coupled to the NDFN 300 In this way, power required by the UMS is provided by the NDFN 300.

Torpedoes are typically launched by a host vessel, for example, a submarine or a surface-level vessel. A traditional submarine is expensive to build and operate, and generally requires 60 to 100 crew members to operate in three shifts. Limitations exist for the command, control and communication in the deep ocean as well as safety and security concerns. There may also be a limited supply of oxygen for the engine and the crew to use. A surface-level vessel, such as a fast attack craft, is typically small in size having to operating in close proximity to land because they lack seakeeping and defensive capabilities. Also, surface-level vessels can be visually detected by an adversary.

Torpedoes are typically launched from a host vessel by a propulsion system or an expulsion system from a torpedo tube. In some implementations, the torpedoes are wire-guided. The loading and launching of the torpedo has multiple steps and is time consuming. Additionally, once the torpedo is launched, the user has no control over the torpedo.

In contrast, the NDFN arrangement is a quick and cost effective way to stealthy launch torpedoes. For example, when using the NDFN to launch a torpedo, the torpedo is capable of being launched underwater from open water without a host vessel. This enables the torpedo to be stealthy launched with no indication or warning to an adversary. Also, the torpedo may be programmed with a navigation plan prior to launch. The torpedo may be programmed with a navigation plan and launched by a user from a control center located on land instead of underwater. In one embodiment, after the torpedo has been launched, the navigation plan includes the torpedo emerging to establish satellite communication before detonation. Once satellite communication are established between the torpedo and the NDFN, the user may have the option of confirming the navigation plan, modifying the navigation plan or aborting the navigation plan. The torpedo then adjusts to the new navigation plan.

Multiple torpedoes may be quickly launched at the same time from the NDFN. Moreover, with the communication network, a torpedo tube, propulsion system, expulsion system and wire are not necessary or needed because the smart mini torpedo is programmed and powered by an engine by its own accord similar to the operation of a car.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention. Furthermore, those of ordinary skill in the art will appreciate that the foregoing description is by way of example only, and is not intended to limit the invention. Thus, it is intended that the present subject matter covers such modifications and variations.

The invention claimed is:

1. A communication network for an aquatic vessel, the communication network comprising:

an unmanned aquatic vehicle configured with a warhead, the unmanned aquatic vehicle capable of i) being programmed with a navigational plan, and ii) establishing satellite communication;

a fiber optic cable, the fiber optic cable being bi-directional and in a closed ring configuration enabling communication within the network and to the unmanned aquatic vehicle;

a power grid cable, the power grid cable being in a closed ring configuration and coupled to a generator providing power within the network and to the unmanned aquatic vehicle;

a node coupled to the fiber optic cable and to the power grid cable; and a relay station coupled to the node and in communication with the unmanned aquatic vehicle;

wherein the fiber optic cable, the power grid cable, the node and the relay station are capable of being located underwater during operation;

wherein the unmanned aquatic vehicle is capable of being launched underwater from open water; and wherein the unmanned aquatic vehicle executes the navigational plan.

2. The communication network of claim 1, wherein the unmanned aquatic vehicle is a smart mini torpedo.

3. The communication network of claim 1, wherein the communication network includes a plurality of unmanned aquatic vehicles.

4. The communication network of claim 1, wherein the unmanned aquatic vehicle further comprises a periscope.

5. The communication network of claim 1, wherein the navigational plan includes a route, a speed profile, a hull size signature of a target vessel, an engine sound signature and a type of warhead to be released.

6. The communication network of claim 5, wherein the unmanned aquatic vehicle is retrievable and reusable when the warhead is nonlethal.

7. The communication network of claim 1, wherein the node is located between 10 miles to 100 miles from a second node.

8. The communication network of claim 1, wherein the communication within the network is by mobile communication, satellite communication or fiber optic communication.

9. The communication network of claim 1, wherein the node further comprises a switch or router for performing dynamic switching based on an Ethernet destination address and an Ethernet source address.

10. The communication network of claim 1, further comprising:

a second fiber optic cable, the second fiber optic cable configured to enable the communication between the relay station and the unmanned aquatic vehicle;

wherein the communication between the relay station and the unmanned aquatic vehicle is maintained for a radius around the relay station based on the length of the second fiber optic cable.

11. The communication network of claim 1, wherein the power grid cable provides more than 14.4 kV of electricity.

12. The communication network of claim 1, wherein the generator is located more than 200 miles from the relay station.

13. The communication network of claim 1, wherein the network connects to a second network by a third fiber optic cable.

14. A method of communication for an aquatic vessel, the method comprising:

providing an unmanned aquatic vehicle, the unmanned aquatic vehicle configured with a warhead, the unmanned aquatic vehicle capable of i) being programmed with a navigational plan, and ii) establishing satellite communication;

positioning a fiber optic cable, the fiber optic cable being bi-directional and in a closed ring configuration enabling communication within a network and to the unmanned aquatic vehicle;

positioning a power grid cable, the power grid cable being in a closed ring configuration and coupled to a generator providing power within the network and to the unmanned aquatic vehicle;

coupling a node to the fiber optic cable and to the power grid cable; and coupling a relay station to the node, the relay station being in communication with the unmanned aquatic vehicle;

wherein the fiber optic cable, the power grid cable, the node and the relay station are capable of being located underwater during operation;

wherein the unmanned aquatic vehicle is capable of being launched underwater from open water; and wherein the unmanned aquatic vehicle executes the navigational plan.

15. The communication network of claim 1, further comprising:

a control center, the control center being in communication with the unmanned aquatic vehicle and facilitating (i) remote control of the unmanned aquatic vehicle, and (ii) programming of a navigational plan for the remote control of the unmanned aquatic vehicle prior to launch.

16. The communication network of claim 1, wherein the unmanned aquatic vehicle is configured with a rechargeable battery, the battery capable of powering the unmanned aquatic vehicle.

17. The communication network of claim 1, wherein the unmanned aquatic vehicle is configured to emerge to a surface of the water and establish satellite communication before a detonation.

18. The communication network of claim 17, wherein when satellite communication is established, a user i) confirms the navigational plan, ii) modifies the navigational plan or iii) aborts the navigational plan.

19. The communication network of claim 1, wherein the unmanned aquatic vehicle utilizes digital signal processing to calculate a position of a second vessel.

20. The communication network of claim 1, wherein the unmanned aquatic vehicle is configured to have a density equivalent to a density of sea water.

* * * * *